US005842089A

United States Patent [19]

Kunihiro et al.

[11] Patent Number: 5,842,089

[45] Date of Patent: Nov. 24, 1998

[54] DEVELOPMENT APPARATUS FOR DEVELOPING ELECTROSTATIC LATENT IMAGE HELD BY HOLDER BY USING NONMAGNETIC ONE COMPONENT DEVELOPER

[75] Inventors: Hisashi Kunihiro; Kouji Shinkawa; Masato Asanuma; Yukihisa Imaue, all of Nara; Itaru Kawabata, Kashiba, all of Japan

[73] Assignee: Sharp Kabushiki Kaisha, Osaka, Japan

[21] Appl. No.: 899,481

[22] Filed: Jul. 24, 1997

[30] Foreign Application Priority Data

Jul. 24, 1996 [JP] Japan ..... 8-194220

[51] Int. Cl.[6] ..... G03G 15/01; G03G 15/08

[52] U.S. Cl. ..... 399/223; 399/290

[58] Field of Search ..... 399/222, 223, 399/225, 228, 230, 252, 265, 266, 290, 294

[56] References Cited

U.S. PATENT DOCUMENTS

| | | | |
|---|---|---|---|
| 2,932,548 | 4/1960 | Nau et al. | 399/290 X |
| 3,623,453 | 11/1971 | Seimiya et al. | 399/290 X |
| 3,633,544 | 1/1972 | Weiler | 399/290 X |
| 4,386,577 | 6/1983 | Hosono et al. | 399/274 |
| 4,421,057 | 12/1983 | Hosono et al. | 399/274 |
| 4,458,627 | 7/1984 | Hosono et al. | 399/274 |
| 4,527,884 | 7/1985 | Nusser | 399/266 |
| 4,876,573 | 10/1989 | Kamimura | 399/266 |

FOREIGN PATENT DOCUMENTS

| | | |
|---|---|---|
| 54-43038 | 5/1979 | Japan . |
| 59-25218 | 6/1984 | Japan . |
| 63-26667 | 2/1988 | Japan . |
| 63-16736 | 4/1988 | Japan . |
| 1-204082 | 8/1989 | Japan . |

*Primary Examiner*—William J. Royer
*Attorney, Agent, or Firm*—Birch, Stewart, Kolasch and Birch, LLP

[57] ABSTRACT

The present invention is intended to provide a compact development apparatus using a nonmagnetic one-component toner. The apparatus comprises a toner storage container, a toner supply roller, a toner passage through which supplied toner passes, and an attracting fan for attracting the toner and generating a toner powder stream. The toner is held in the toner storage container. The toner supply roller supplies the toner from a supply port of the storage container. The toner passage is provided with an opening opposite to a photosensitive drum. The toner supplied into the toner passage and frictionally charged is attracted by the attracting fan. The toner travels from the opening to the drum. The toner adheres to an electrostatic latent image on the drum and thus the image is developed. Unused toner is transported into the toner passage and recovered.

7 Claims, 18 Drawing Sheets

DEVELOPMENT APPARATUS FOR DEVELOPING ELECTROSTATIC LATENT IMAGE HELD BY HOLDER BY USING NONMAGNETIC ONE COMPONENT DEVELOPER

BACKGROUND OF THE INVENTION

1. Field of the Invention

The present invention relates to a development apparatus for making visible an electrostatic latent image on a latent image holder, using a nonmagnetic one-component developer in an electrophotographic process within a copier, laser printer, or the like.

2. Description of the Related Art

Some kinds of development used for an electrophotographic process use a nonmagnetic one-component developer or toner. Since the developer consists only of a toner, no carrier is necessary. Also, any mechanism for controlling the toner concentration is dispensed with. Furthermore, servicing operations such as replacement of the developer are not required. Therefore, the development mechanism can be simplified. Consequently, the development apparatus can be made smaller and maintenance-free at a lower cost.

For example, a development apparatus of this kind has a metal roller located close to a photosensitive (PC) drum. This roller has a sleeve on which a toner is charged and held. The toner is transferred to an electrostatic latent image on the PC drum. A method of charging and holding the toner in a thin uniform state on the sleeve is disclosed, for example, in Japanese Examined Patent Publication JP-B2 63-16736 (1988), where a resilience-limiting plate made of rubber or a metal having resilience is pressed against the sleeve to form the toner into a thin uniform layer.

Various methods are used to cause the toner on the sleeve to travel to the photosensitive drum. For instance, in Japanese Unexamined Patent Publication JP-A 63-26667(1988), a toner is held in the form of a mist in a space between a hollow cylindrical tube and the surface of the photosensitive drum. The hollow cylindrical tube is employed to stir the toner transferred to it. An auxiliary charging member applies an alternating electric field between the space and the surface of the photosensitive drum to cause the toner to travel. In Japanese Unexamined Patent Publication JP-A 1-204082(1989), a mechanical impacting force is applied to a toner carried on a supply belt to make the toner afloat. Thus, local powder clouds are successively created to transfer the toner to the photosensitive drum.

In addition, nonmagnetic toners place no limitations on colors, because they contain no magnetic substances, unlike magnetic toners. Therefore, nonmagnetic toners are adapted for color printing. In a multicolor development method typically used in a full-color copier, developing units holding toners of yellow, magenta, cyan, and black, respectively, are juxtaposed opposite to a latent image holder such as a photosensitive drum or a photosensitive belt. A toner image is created on the photosensitive drum for each one color, thus producing a color image.

A development apparatus using the aforementioned toner must form a thin uniform layer of the toner on the metal roller. To apply the toner uniformly to the metal roller, the resilience-limiting plate is pushed against the sleeve. To stabilize the charging characteristics of the toner, the surface of the sleeve is sandblasted. In the case of this structure, the resilience-limiting plate is kept in sliding contact with the sleeve. Therefore, it is necessary that the resilience-limiting plate and the sleeve have sufficient wear resistance. Consequently, this apparatus is unsuited for applications requiring high speeds and long life such as high-speed copier machines. Also, the materials of the resilience-limiting plate and of the sleeve must be selected from a limited choice of materials. Furthermore, the sleeve must undergo a second machining operation. Additionally, an accurate gap must be secured between the photosensitive drum and the sleeve. For these reasons, the cost is increased.

Further, limitations are placed on the space, because various members such as the metal roller, the hollow cylindrical tube, and the supply belt must be positioned around the photosensitive drum. This makes it impossible to reduce the size because of the large space occupied by the members. Especially when a multicolor development method is used, development units for yellow, magenta, cyan, and black, respectively, are necessitated. Hence, a large space is necessary around the photosensitive drum. Accordingly, in Japanese Examined Patent Publication JP-B2 59-25218 (1984), the development units are designed to rotate about an axis of rotation. Only the used development unit is placed in the development zone. Although the ratio of the space occupied by the development mechanism to the space around the photosensitive body is reduced, additional mechanisms and space are necessary to permit the development units to move. This hinders imparting higher functions to copiers, printers, etc. and miniaturizing them.

SUMMARY OF THE INVENTION

In view of the foregoing, it is an object of the present invention to provide a development apparatus that is composed of a limited number of components and capable of saving space by actively making use of the merits of a nonmagnetic one-component developer.

Means for solving the problems in accordance with the invention comprises a developer passage through which the nonmagnetic one-component developer passes, supply means for supplying the developer into the developer passage, and attracting means for attracting the developer in the developer passage to produce a powder stream. The developer passage is provided with a developing opening that faces an electrostatic latent image holder.

The developer passage is a straight line provided with a developing opening that faces the electrostatic latent image holder. The developer passage comprises an upstream passage for feeding the developer from the supply means toward the latent image holder and a downstream passage for recovering the developer not used for development. A developing opening that faces the latent image holder is formed at the junction of the upstream and downstream passages.

According to the invention, the nonmagnetic one-component developer supplied into the developer passage is attracted to produce a powder stream of the developer. By making use of this stream, the developer is caused to travel from the opening directly to the electrostatic latent image holder.

Therefore, any expensive members such as an accurate metal roller, a resilience-limiting plate, an auxiliary charging member, and a supply belt are made unnecessary. The structure is rendered compact and simple. In consequence, the cost can be reduced. Also, it is necessary that only the developer passage be disposed close to the electrostatic latent image holder; the other members can be positioned in empty space. As a result, space saving can be accomplished easily.

Especially, when the upstream and downstream passages are adjacent to each other and partitioned by a partitioning member, the developer passage can be formed like a nozzle. This reduces the ratio of the space taken by the developer passage around the electrostatic latent image holder. It can contribute immensely to space saving. Where this partitioning member is made of a conductor, and where a bias voltage is applied to the developer passing through the developer passage, sticking of the developer due to residual potential on the electrostatic latent image holder can be prevented. Consequently, fog can be circumvented.

According to the invention, the shape of the front end of the partitioning member or the gap between the opening and the electrostatic latent image holder is designed so that the powder stream of the developer near the opening is appropriate for development. This ensures contact between the developer and the latent image holder and eliminates non-uniformities in the density of the developer. Consequently, the image quality can be improved.

When the developer passage is used as a circulatory passage which goes close to the electrostatic latent image holder from the supply means and again reaches the supply means and is provided with a developing opening facing the latent image carrier holder, unused developer can be recovered and reused.

Where a reversely charged developer recovery member charged with the same polarity as the developer is mounted in the developer passage downstream of the opening, the reversely charged developer contained in the developer proper can be recovered. Therefore, deteriorations of the characteristics of the developer inside the supply means which would normally be caused by reversely charged developer can be prevented.

Powder stream control means is mounted to control the powder stream according to the surrounding circumstances so that the image quality is made uniform. The surrounding circumstances mean deteriorations of other members induced by environmental conditions such as temperature and moisture or due to the limited service life of the hardware. These variations change the developing conditions and so the density of the developer or the speed of the powder stream is varied by adjusting the amount of the developer supplied or the attracting force. In this way, the powder stream of the developer is controlled so that the development is made optimally according to the surrounding conditions.

A movable member is mounted at the opening to vary its shape. Opening control means is provided to activate the movable member in order that the powder stream of the developer near the opening be varied according to the required image quality. For example, the front end of the partitioning member is made movable. The upstream or downstream side of the opening is widened or narrowed to move the nip relative to the electrostatic latent image holder or to vary the width of the opening. Since the shape of the opening is varied in this manner, the powder stream in the vicinity of the opening changes.

Accordingly, when the original document needs halftone images or dark images, the movable member is activated. Then, the developer makes contacts more softly with the electrostatic latent image holder, or a sufficient amount of developer can be supplied to the latent image holder. Hence, the reproducibility can be enhanced.

In accordance with the invention, the powder stream of the developer is controlled according to the environmental conditions or the shape of the opening is adjusted according to the required image, so that the amount of the developer supplied or the velocity of the powder stream is varied. The resulting powder stream of the developer permits optimum development. Consequently, the image quality can be improved.

In the development apparatus described above, the supply means can be equipped with plural developer storage containers holding developers of different colors. In this case, developers of different colors are successively supplied from the developer storage containers through the developer passage. Accordingly, a compact full-color development apparatus can be provided.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
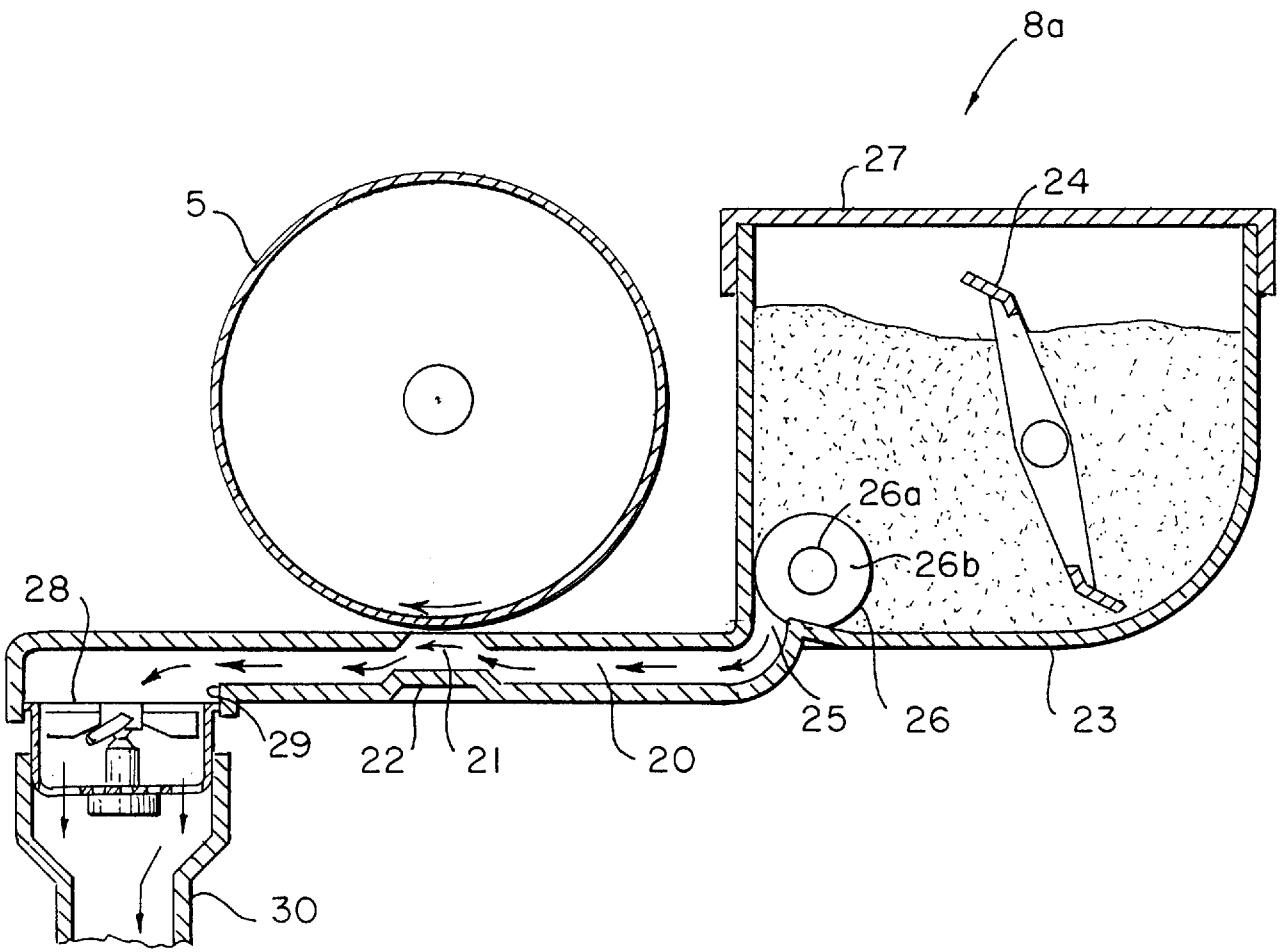
FIG. 1 is a cross-sectional view showing the fundamental structure of a development apparatus 8*a* forming a first embodiment of the invention.

Now referring to the drawings, preferred embodiments of the invention are described below.

Development apparatuses built in accordance with the present invention use a toner consisting of a nonmagnetic one-component developer and are described below.

First Embodiment

Figure 2:
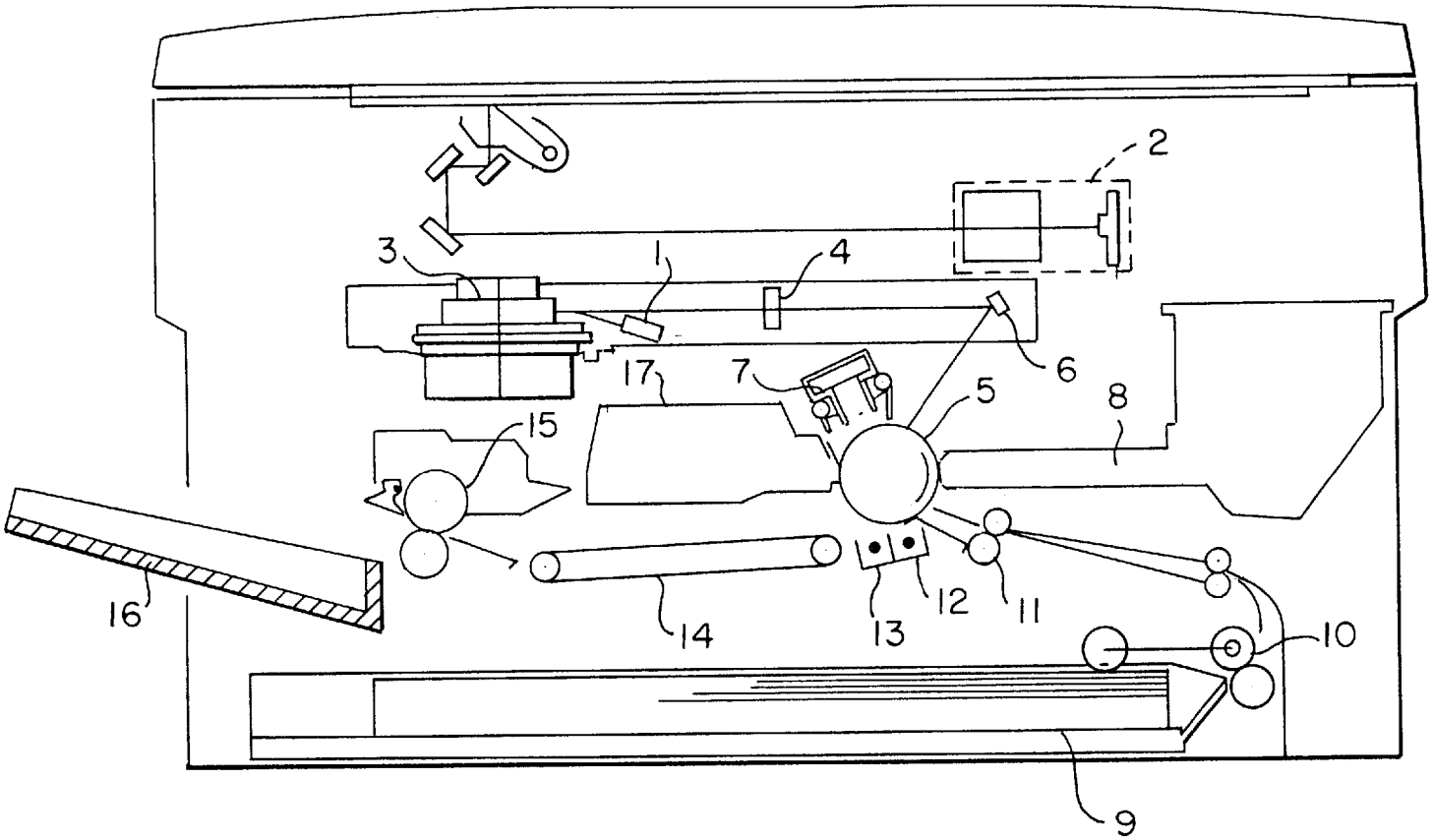
FIG. 2 is a schematic view of a printer equipped with a development apparatus in accordance with the invention.

A laser beam printer equipped with a development apparatus in accordance with the invention is shown in FIG. 2, where a semiconductor laser 1 emits a laser beam that is modulated according to a signal indicating recorded information. This signal is produced from a document reader 2 or a computer. This laser beam is scanned by a rotary polyhedron 3 and focused via a mirror 6 onto the surface of a photosensitive (PC) drum 5 by a focusing lens 4. The photosensitive drum 5 is an electrostatic latent image holder. This PC drum 5 rotates in the direction indicated by the arrow, and its surface is uniformly charged by a main charger 7. Then, the PC drum is exposed by the laser beam scanned in a direction substantially parallel to the axis of rotation of the photosensitive drum 5. As a result, an electrostatic latent image is created on the surface of the photosensitive body 5. This latent image is developed with a toner supplied from a development apparatus 8, thus generating a visible image. This visible image on the photosensitive body 5 is transferred to paper by a transfer charger 12. The paper is supplied from a transfer paper cassette 9 by paper feed rollers 10 and resist rollers 11. The paper is peeled off from the surface of the photosensitive body 5 by a scraping charger 13 and transported onto a fusser 15 by a transport belt 14. Then the paper on which the toner image has been fixed by the fusser 15 is discharged onto a feeder output tray 16. Meanwhile, toner remaining on the surface of the photosensitive body 5 is recovered from the surface of the photosensitive body 5 by a cleaner 17.

FIG. 1 is a cross-sectional view showing the fundamental structure of a development apparatus forming a first embodiment. This development apparatus, indicated by 8*a*, comprises a toner passage 20 through which the toner passes, supply members for supplying the toner into the toner passage 20, and an attracting member for attracting the toner from inside the toner passage 20 to produce a powder stream. This powder stream causes the toner to travel from the toner passage 20 to the photosensitive body 5, thus carrying out a development.

The toner passage 20 is shaped like a hollow box whose width is roughly equal to the longitudinal dimension of the photosensitive body 5. This passage 20 is located inside the body of the printer and close to the photosensitive body 5. A developing opening 21 is formed on one side of the passage 20 that faces the photosensitive body 5 and extends longitudinally of the photosensitive body 5. A protrusion 22 is formed at the other side and extends toward said one side. The toner passage 20 is narrowed near the opening 21 and has a length corresponding to the development zone on the photosensitive body 5. Both end surfaces of the opening 21 are tilted in opposite directions. The opening 21 is gradually narrowed outwardly from inside.

The supply member is composed of a toner storage container 23 holding a toner, a toner-stirring roller 24 for stirring the held toner, and a toner supply roller 26 mounted at a supply port 25 formed at the bottom surface of the toner storage container 23. This storage container 23 is located upstream of the toner passage 20 and in communication with the toner passage 20 via the supply port 25. The top surface of the toner storage container 23 is open but closed off by a top cover 27 through which a toner is replenished.

The toner-stirring roller 24 and the toner supply roller 26 are rotatably held to the toner storage container 23. These rollers are driven either by their respective electric motors or by a common motor. The toner supply roller 26 comprises a metallic core 26*a* made of a free-cutting steel and urethane sponge 26*b* adhesively bonded to the outer surface of the core. The toner is stirred inside the toner storage container 23 and triboelectrically charged. Although the toner is also triboelectrically charged when the toner supply roller 26 turns to supply the toner, the amount of charge conferred on the toner is affected greatly by the size of the toner particles supplied from the toner supply roller 26. This size can be set at will by the expansion ratio (the number of cells) of the urethane sponge 26*b* of the toner supply roller 26. Therefore, an appropriate toner charge level can be obtained by setting the number of cells within a given range.

Figure 3:
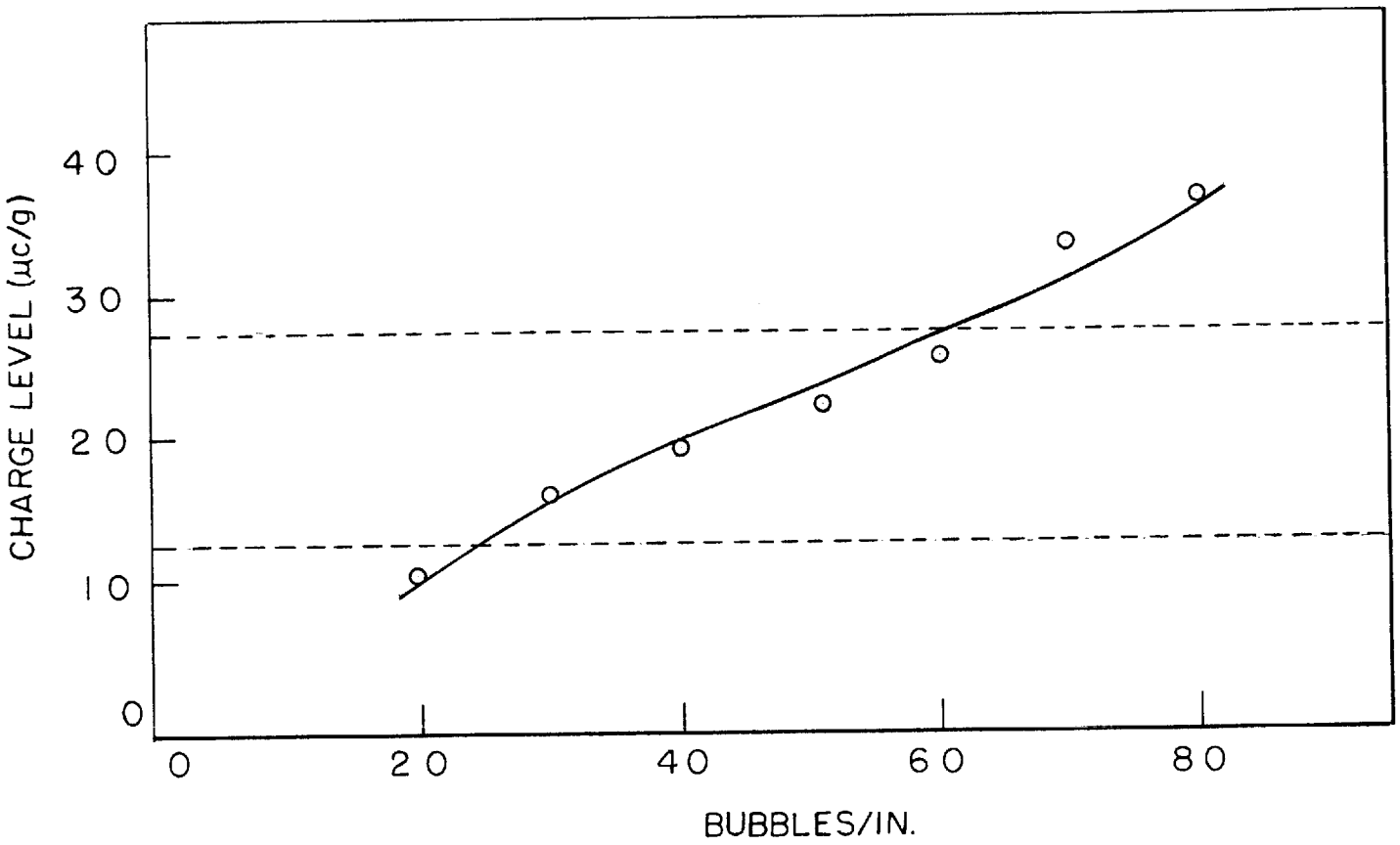
FIG. 3 is a diagram in which the amount of charge imparted to a developer is plotted against the number of bubbles in a developer supply roller.

More specifically, the charge level was measured for each of different cell numbers. The results are shown in FIG. 3. The appropriate charge level of the toner is set to 12–28 $\mu$c/g, taking account of the image concentration and image quality such as fog. In this case, it is observed that the number of cells should be set to 30 to 60 per inch. This can stabilize the charging characteristics of the toner passing through the toner passage 20.

The attracting member consists of an attracting fan 28 such as an axial fan. This attracting member is disposed in a circular exit 29 formed downstream of the toner passage 20. A recovery tube 30 is connected to the downstream side of the attracting fan 28, and is in communication with a toner recovery container (not shown). When the attracting fan 28 is located upstream of the opening 21 of the toner passage 20, the toner is blown against the photosensitive body 5 and scatters out of the machine through the opening 21. However, when the attracting fan 28 is located downstream of the opening 21 of the toner passage 20, it follows that outside air is sucked from the opening 21, thus preventing scattering of the toner. Instead of the attracting fan 28, a pump may be used.

In this structure, as a process for forming an image is started, the toner held in the toner storage container 23 is stirred by the toner-stirring roller 24. Then, the toner is transported from the supply port 25 into the toner passage 20 by rotation of the toner supply roller 26. At the same time, the attracting fan 28 operates to attract the triboelectrically charged toner, creating a powder stream. This stream passes through the toner passage 20. At this time, the toner is electrostatically attracted to the electrostatic latent image on the photosensitive body 5 from the opening 21 near the photosensitive body 5. In this way, the image is developed. Meanwhile, the used toner not adhering to the photosensitive body 5 passes through the toner passage 20 intact, and is sent into the toner recovery container via the recovery tube 30.

By generating the powder stream of the toner in this way, the toner can be brought into direct contact with the photosensitive body 5 by making use of an air stream. Accordingly, expensive members such as an accurate metallic roller, a resilience-limiting member, an auxiliary charging member, and a supply belt can be omitted. This structure is made simpler, and the cost can be reduced. Furthermore, only the toner passage 20 is required to be placed close to the photosensitive body 5. The other members can be positioned in empty space. The inside of the machine can be laid out arbitrarily. Hence, space saving can be easily accomplished.

Figure 4:
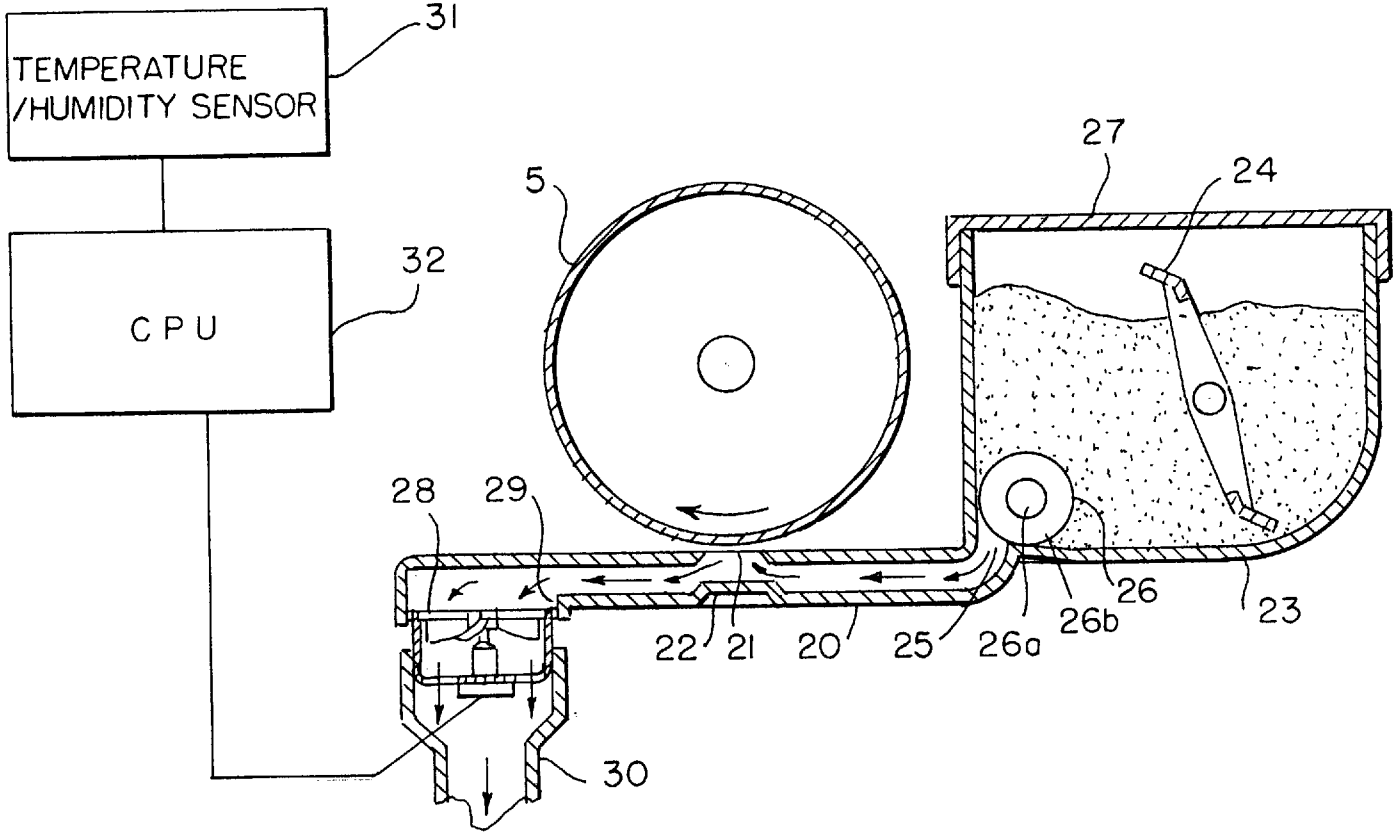
FIG. 4 is a cross-sectional view showing the fundamental structure of a development apparatus having a powder stream-controlling function.

The fluidity of the toner is affected by the environmental conditions such as temperature and humidity. Especially in high-temperature humid conditions, the fluidity of the toner drops, so that a sufficient amount of toner is not supplied to the photosensitive body 5. This lowers the image concentration. Accordingly, as shown in FIG. 4, a temperature/humidity sensor 31 is mounted to the body of the printer. This printer incorporates a CPU 32 having a powder stream-controlling function to control the powder stream of the toner according to the environmental variations, for maintaining the image quality constant.

The CPU 32 varies the input voltage to the attracting fan 28 according to the output signal from the temperature/humidity sensor 31, thus changing the rotational speed of the fan. This in turn varies the attracting force of the attracting fan 28, thus altering the speed of the powder stream of the toner. Specifically, when the temperature exceeds 35° C. or the humidity goes above 60% RH, the rotational speed of the attracting fan 28 is switched. The CPU performs a control operation to increase the rotational speed of the attracting fan 28 that has been kept constant. Therefore, even if the fluidity of the toner drops, the attracting force of the attracting fan 28 increases. Consequently, the speed of the powder stream of the toner is adjusted to compensate for the change in the fluidity of the toner. A sufficient amount of toner for development is supplied to the photosensitive body 5. The image concentration is prevented from deteriorating. Also, image quality deterioration is prevented and high image quality can be maintained.

In the above description, the rotational speed of the attracting fan 28 is switched in a stepwise fashion. It is also possible to change the rotational speed of the attracting fan 28 in minute steps according to the temperature and humidity, for controlling the speed of the powder stream of the toner.

Figure 5:
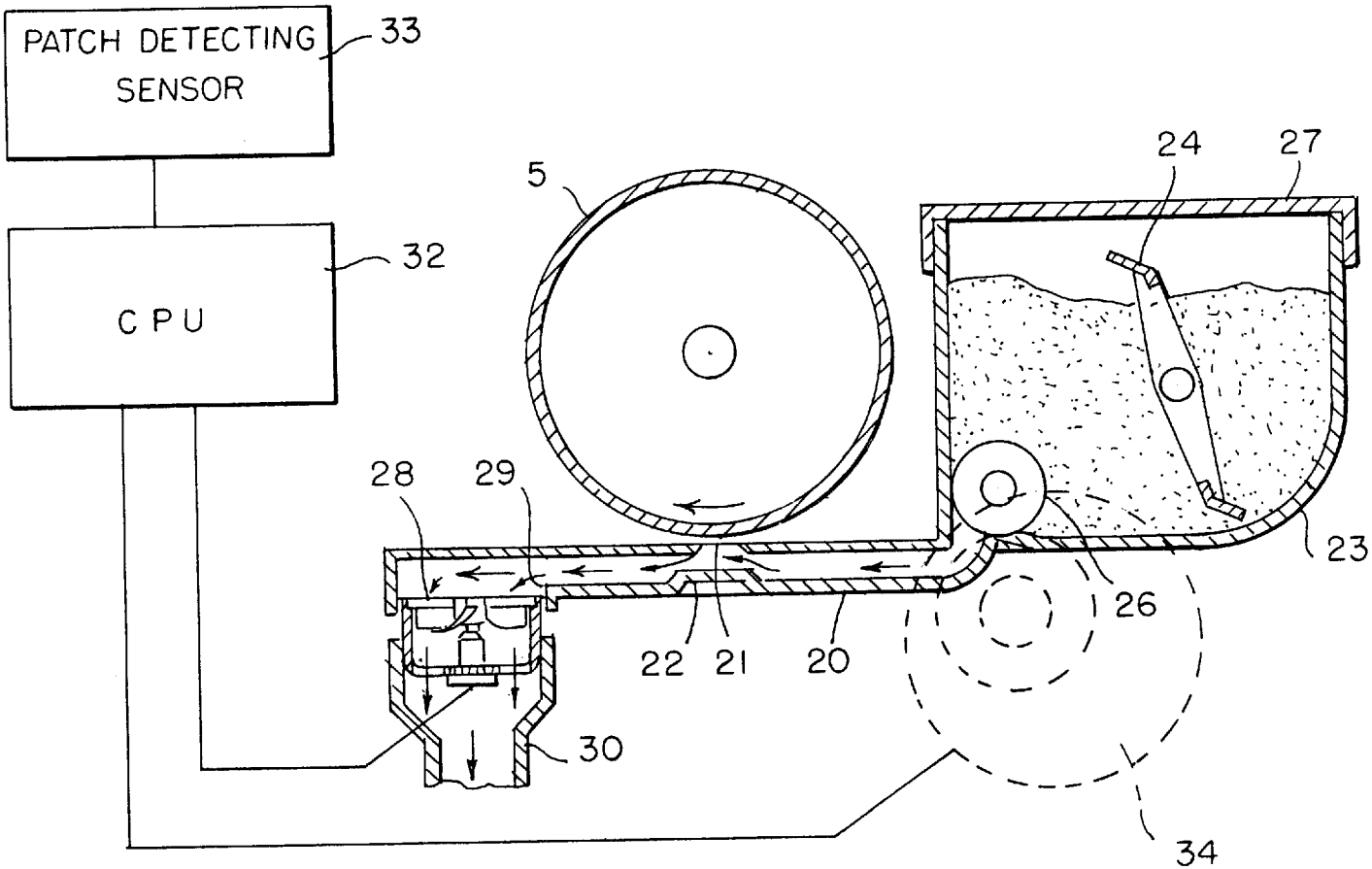
FIG. 5 is a cross-sectional view showing the fundamental structure of another development apparatus having a powder stream-controlling function.

The image concentration may be deteriorated or fog may be induced by deterioration of the illuminance of the copier lamps, toner deterioration, deterioration of the charging wires, and other hardware conditions, as well as by environmental variations. Accordingly, as shown in FIG. 5, a toner patch is created over the photosensitive body 5, and a patch-detecting sensor 33 such as an IR sensor for detecting the image concentration is provided. A powder stream-controlling function for controlling the powder stream of the toner according to data obtained by detecting the patch is conferred to the CPU 32 in order to retain the image quality constant.

The CPU 32 senses the presence of fog and calculates its degree from the data obtained by detecting the patch. The CPU sets toner charge level and toner density to appropriate values to remove the fog while securing the image concentration. In particular, when the attracting force is increased in spite of a small amount of toner supplied, the speed of the powder stream of the toner increases, increasing the charge level of the toner. As a result, the background on the photosensitive body is less likely to be fogged. However, when these values are set to extreme values, the original image concentration will be affected. As an example, therefore, these values can be switched between five settings or so. The input voltage to a motor 34 driving the toner supply roller 26 and the input voltage to the attracting fan 28 are switched between these settings according to the degree of fog or the like expected from the data obtained by detecting the patch.

The amount of toner supplied and the amount of toner attracted are varied by switching the rotational speeds of the toner supply roller 26 and of the attracting fan 28 in this way. As a result, the density and speed of the powder stream of the toner are changed. Accordingly, even when the ambient conditions and the image concentration vary due to aging characteristics of the machine, the amount of toner supplied and the amount of toner attracted are corrected to their optimum values according to data obtained by detecting the patch. Consequently, the density and speed of the powder stream of the toner are matched to the image quality. The result is that fog is prevented and uniform image concentration is obtained. Also, the image quality is kept constant. In consequence, stable images can be obtained throughout the service life.

Where the operation of the toner supply roller 26 and the attracting fan 28 is controlled according to the two factors, i.e., the output signal from the temperature/humidity sensor 31 and the data supplied from the patch-detecting sensor 33, the effects of the ambient conditions on the development can be completely eliminated. This assures stable developing operation and image quality can be stabilized.

Second Embodiment

Figure 6:
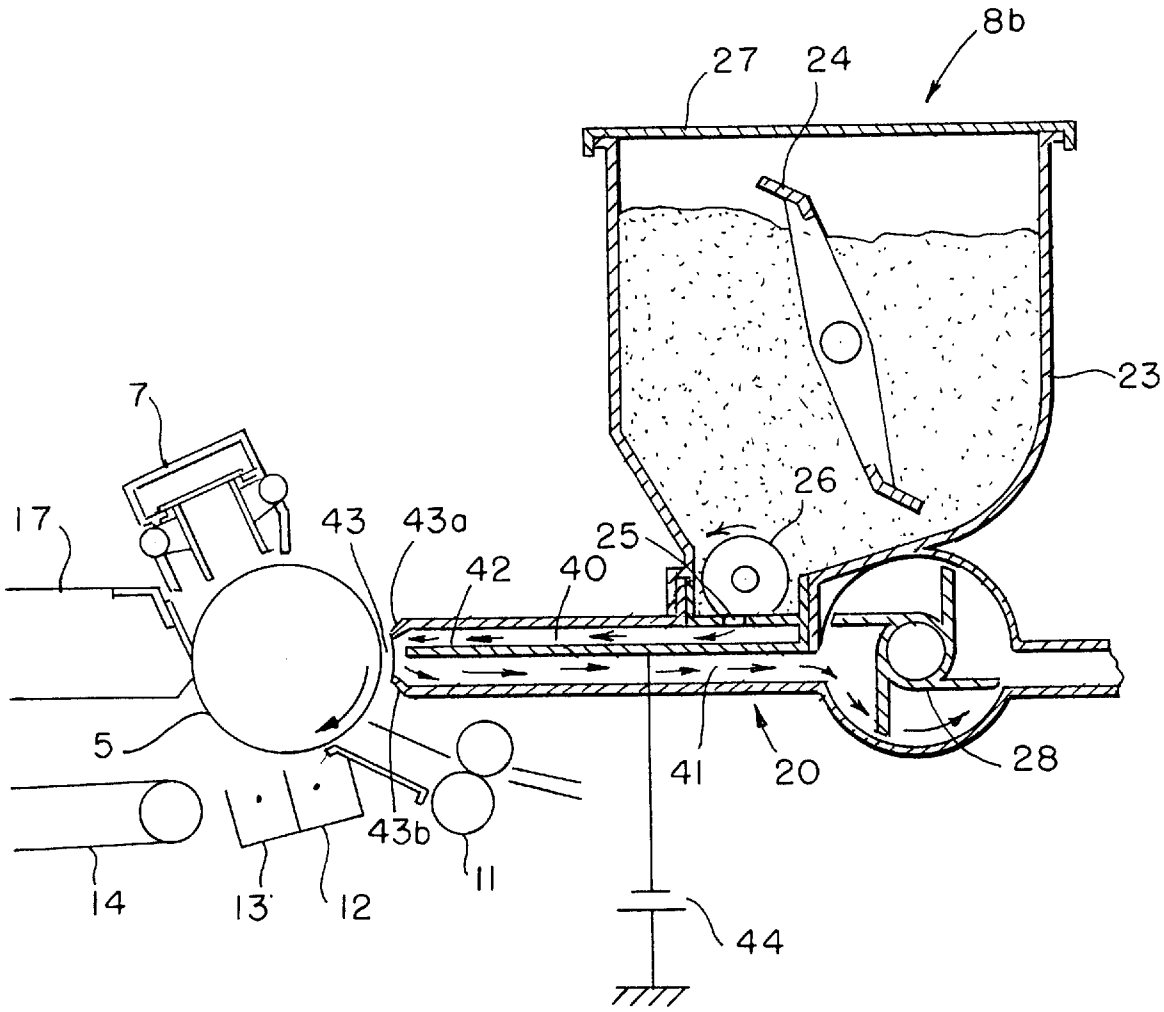
FIG. 6 is a cross-sectional view showing the fundamental structure of a development apparatus 8*b* forming a second embodiment of the invention.

FIG. 6 is a cross-sectional view showing the fundamental structure of a development apparatus forming a second embodiment. This development apparatus, indicated by 8*b*, has a photosensitive (PC) drum 5, and is characterized in that space saving is attained around the photosensitive body 5. For this purpose, the powder stream of a toner is caused to make a U-turn. Specifically, a toner passage 20 is shaped like a boxlike nozzle. This passage 20 comprises an upstream passage 40 and a downstream passage 41. The upstream passage 40 directs the toner from a toner storage container 23 toward the photosensitive body 5. The downstream passage 41 urges the toner not used for development into a toner recovery container. The upstream passage 40 and the downstream passage 41 are adjacent to each other and partitioned by a partitioning member 42.

An attracting member comprises an attracting fan 28 consisting of a paddle fan extending longitudinally of the photosensitive body 5 and mounted in the downstream passage 41. This development apparatus is similar to the development apparatus 8*a* of the first embodiment except for the structure of the toner passage 20. In this embodiment, the various components are integrated so that the development apparatus is fabricated as a unit. Consequently, the apparatus is easy to handle.

An opening 43 located opposite to the photosensitive body 5 is formed at the junction of the upstream passage 40 and the downstream passage 41. The opening 43 is a rectangular hole surrounded by both an upstream end portion 43*a* and a downstream end portion 43*b* forming the toner passage 20. This opening 43 extends longitudinally of the photosensitive body 5. The front ends of the upstream end portion 43*a* and the downstream end portion 43*b* are bent so as to face each other. The area of the opening gradually decreases toward the photosensitive body 5 to prevent the powder stream of the toner from scattering outward. The cross-sectional area of the upstream passage 40 is set smaller than that of the downstream passage 41 to enhance the attraction efficiency near the opening 43. This assures that the toner is recovered without scattering.

For example, the partitioning member 42 is made of a flat conductive plate of stainless steel. The front end of this partitioning member is located slightly inwardly of the front end of the opening 43. A dc power supply 44 applies a bias voltage of 150 to 200 V to the partitioning member 42. Thus, the bias voltage is applied to the toner passing through the toner passage 20. This prevents sticking of the toner which would otherwise be caused by the potential remaining on the photosensitive body 5. Consequently, the image quality can be improved with a simple structure by making use of this partitioning member 42.

Figure 7:
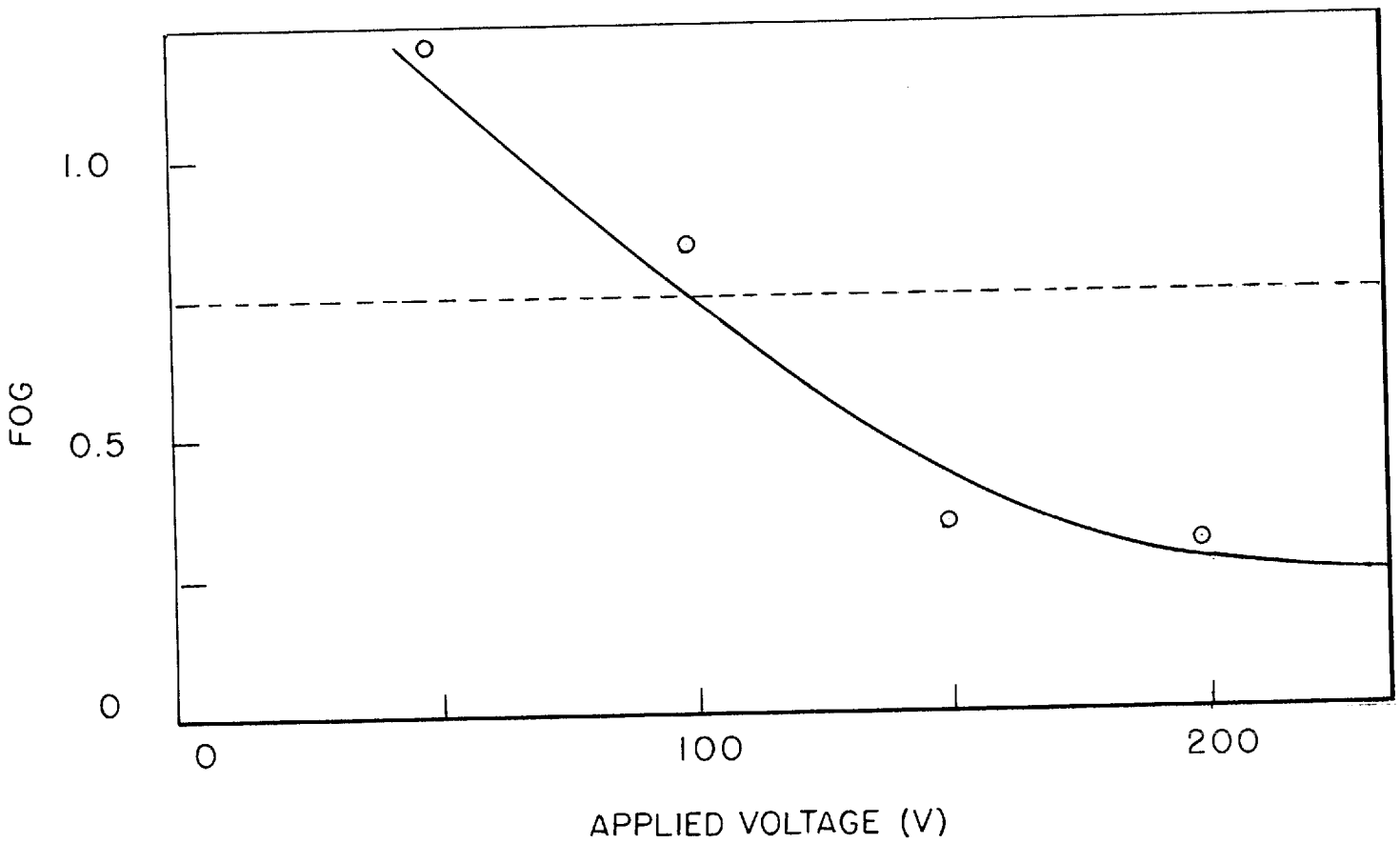
FIG. 7 diagram showing the effect of the voltage applied to a partitioning member on fog.

Copies were made while varying the bias voltage from 50 to 200 V. Adhesion (fog) of the toner to nonimage areas was measured. The results are shown in FIG. 7. The judgment was made, based on visual observation. It was observed that levels at which no fog was found were at or less than 0.75 V. It can be seen that it is necessary to apply a bias voltage of more than 100 V, preferably 150 V.

In this structure, as a process for forming an image is initiated, the toner held in the toner storage container 23 is stirred by the toner-stirring roller 24. Then, the toner is transported from the supply port 25 into the upstream passage 40 by rotation of the toner supply roller 26. Concurrently, the attracting fan 28 operates to attract the triboelectrically charged toner, creating a powder stream. This stream flows through the upstream passage 40 and reaches the opening 43. At this time, the toner is drawn into the downstream passage 41 near the opening 43. The sense of the stream is changed so as to make a U-turn. The toner flying off the opening 43 comes into contact with the photosensitive body 5. A part of the toner electrostatically adheres to the electrostatic latent image on the photosensitive body 5, thus developing the image. Meanwhile, the used toner not adhering to the photosensitive body 5 is drawn into the downstream passage 41 intact, and is sent into the toner recovery container.

By generating the powder stream of the toner inside the nozzle-like toner passage 20 in this way, the toner can be brought into direct contact with the photosensitive body 5. Accordingly, it is only necessary to place the opening 43 of the toner passage 20 in the development zone on the photosensitive body 5. Only a small part of the outer circumference of the photosensitive body 5 is taken up. The other members can be placed in spaces that are convenient for the specifications of the machine. The inside of the machine can be laid out at will. In consequence, space saving can be easily accomplished.

It is necessary that the toner show uniform density in the longitudinal direction. However, the density is not always uniform because of variations in accuracy between the components of the toner supply roller 26. Under this condition, if the image is developed, then black stripes, nonuniformities in the concentration, or other defects may take place on the final print. Accordingly, homogenizing means is mounted upstream of the opening 43 to adjust the flow rate of the toner stream in the longitudinal direction so as to make the stream uniform in the longitudinal direction.

Figure 8:
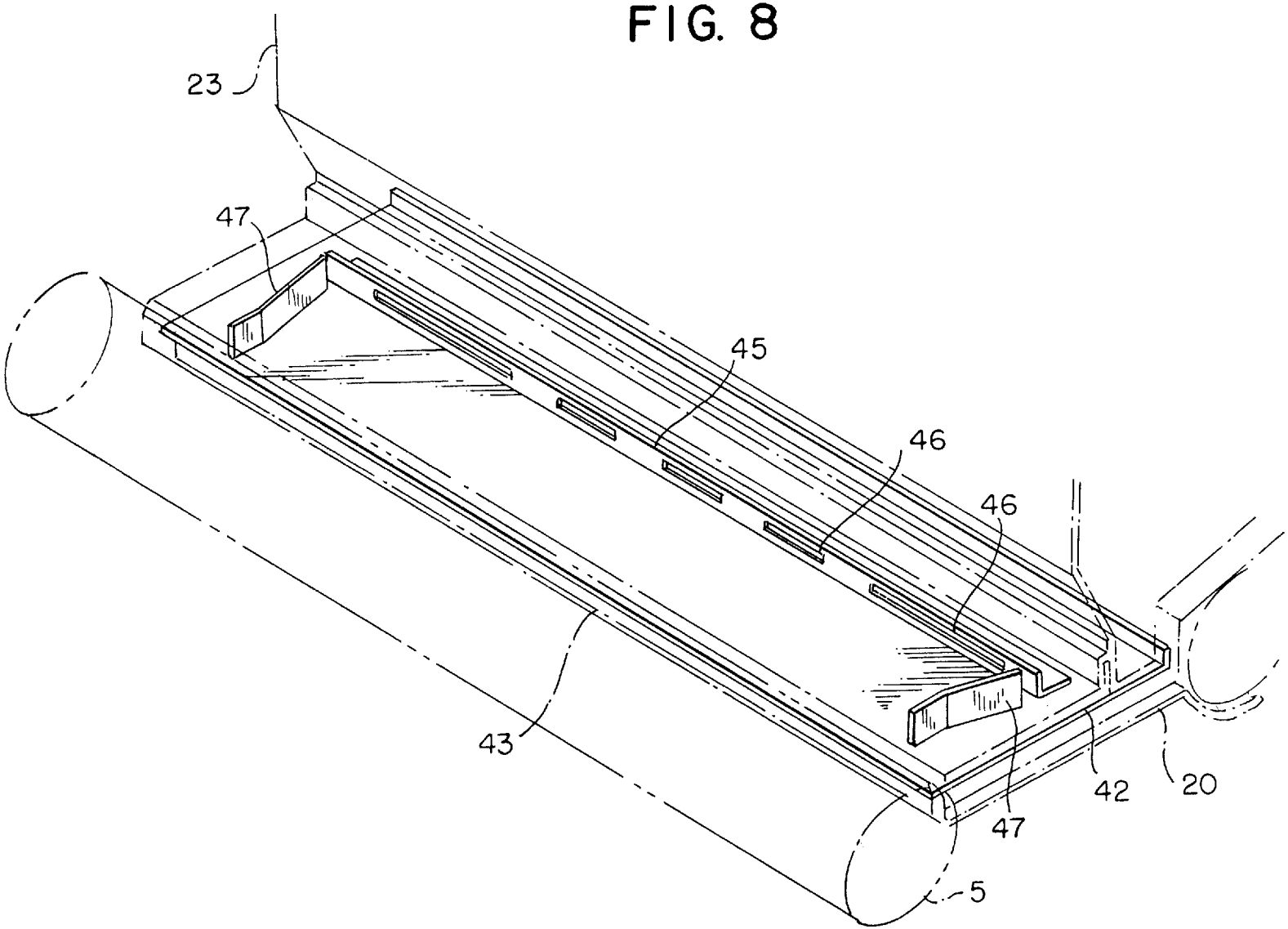
FIG. 8 is a perspective view of a partitioning member equipped with homogenizing means.

The homogenizing member can be a regulator plate 45 mounted on the partitioning member 42 in the upstream passage 40, as shown in FIG. 8. The regulator plate 45 is provided with a plurality of holes 46 in the longitudinal direction. The center hole 46 is made smaller than the holes 46 at both ends so that the toner passes across both ends at a higher rate. This disperses the toner powder stream, resulting in stirring of the toner in the longitudinal direction. Therefore, the toner powder stream is rendered uniform in the longitudinal direction. Consequently, before development, nonuniformities in the amount of toner supplied in the longitudinal direction can be averaged out.

Although the nonuniformities in the density of the toner powder stream are alleviated by this regulator plate 45, outside air is attracted at a higher rate at both ends of the toner passage 20 than in the center, because the attracting force of the attracting fan 28 is utilized. Therefore, the density of the toner powder stream is smaller at both ends than in the center. Where the size of the transfer paper is large, the image density may be lower at both ends than in the center. To make the toner powder stream uniform in the longitudinal direction with greater certainty, a pair of opposite toner width-limiting plates 47 having ribs are mounted downstream of the regulator plate 45. These toner width-limiting plates 47 are tilted inward in the downward direction.

As a result, disturbance of the toner powder stream due to attraction of outside air at both ends of the stream is prevented. This in turn prevents the density of the toner powder stream at both ends from decreasing. Hence, the density can be maintained in the longitudinal direction. Thus, a toner powder stream that is uniform in the longitudinal direction can be obtained. Accordingly, where the size of the transfer paper is large, the image concentration can be maintained at both ends, and the image at both ends is kept from getting faint and patchy.

Figure 9:
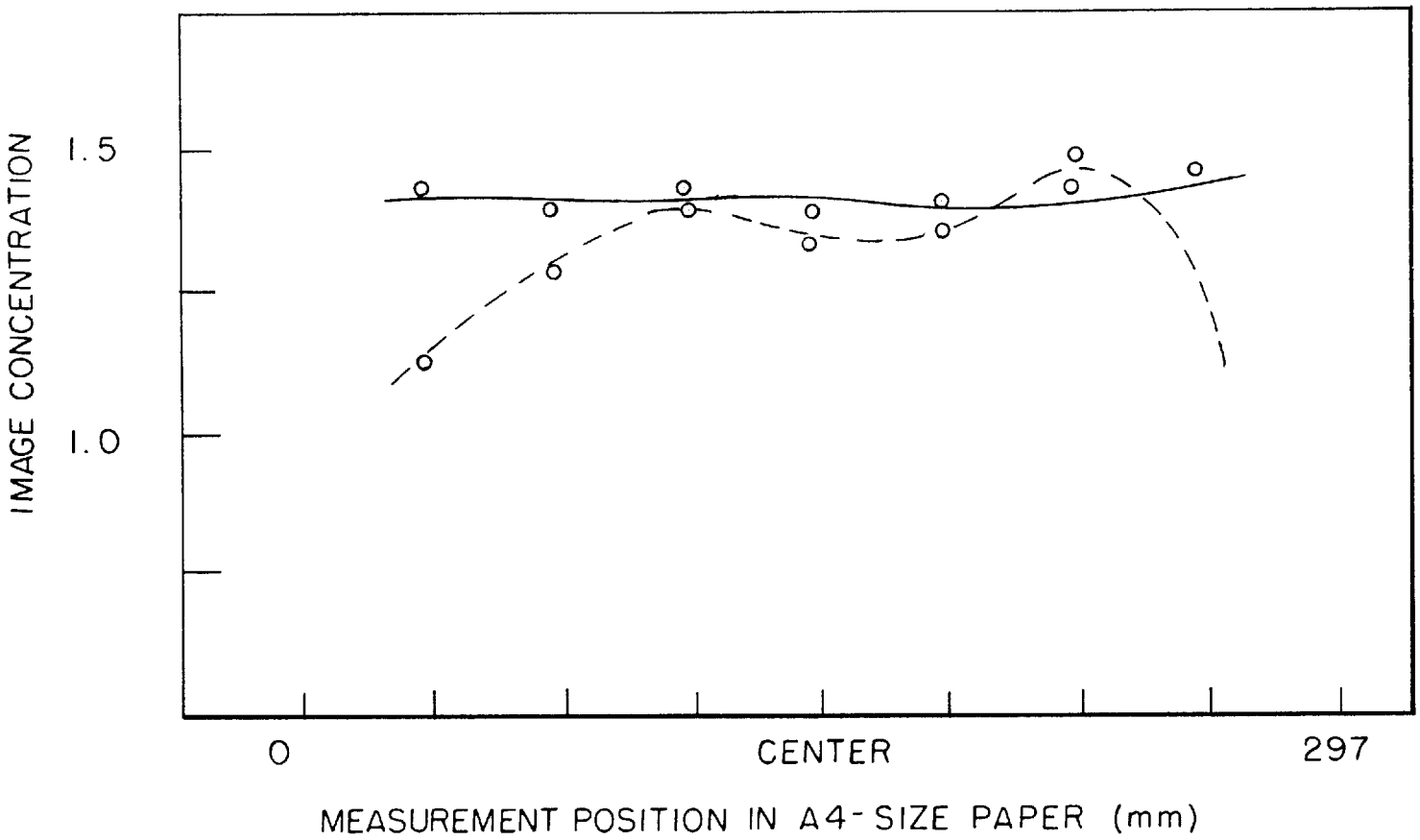
FIG. 9 is a diagram showing the effect of the presence or absence of the homogenizing means on the image concentration.

The presence or absence of effects of the aforementioned homogenizing member on the image concentration was examined. The results are shown in FIG. 9, where the solid line indicates cases where the homogenizing means is provided and the dotted line indicates cases where no homogenizing means is provided. It can be seen that the image concentration is preferably more than 1.35 over the whole surface of the transfer paper, and that the homogenizing member reduces concentration nonuniformities in the center of the paper and at both ends.

Where the front end of the partitioning member 42 is set parallel to the photosensitive body 5, if the fluidity of the toner deteriorates under uncommon conditions such as high-temperature, humid conditions, the stream does not easily pass between the photosensitive body 5 and the partitioning member 42, so that the stream cannot make a U-turn smoothly. Then, excess toner will stay and adhere to the photosensitive body 5. As a result, high image quality may not be obtained.

Figure 10:
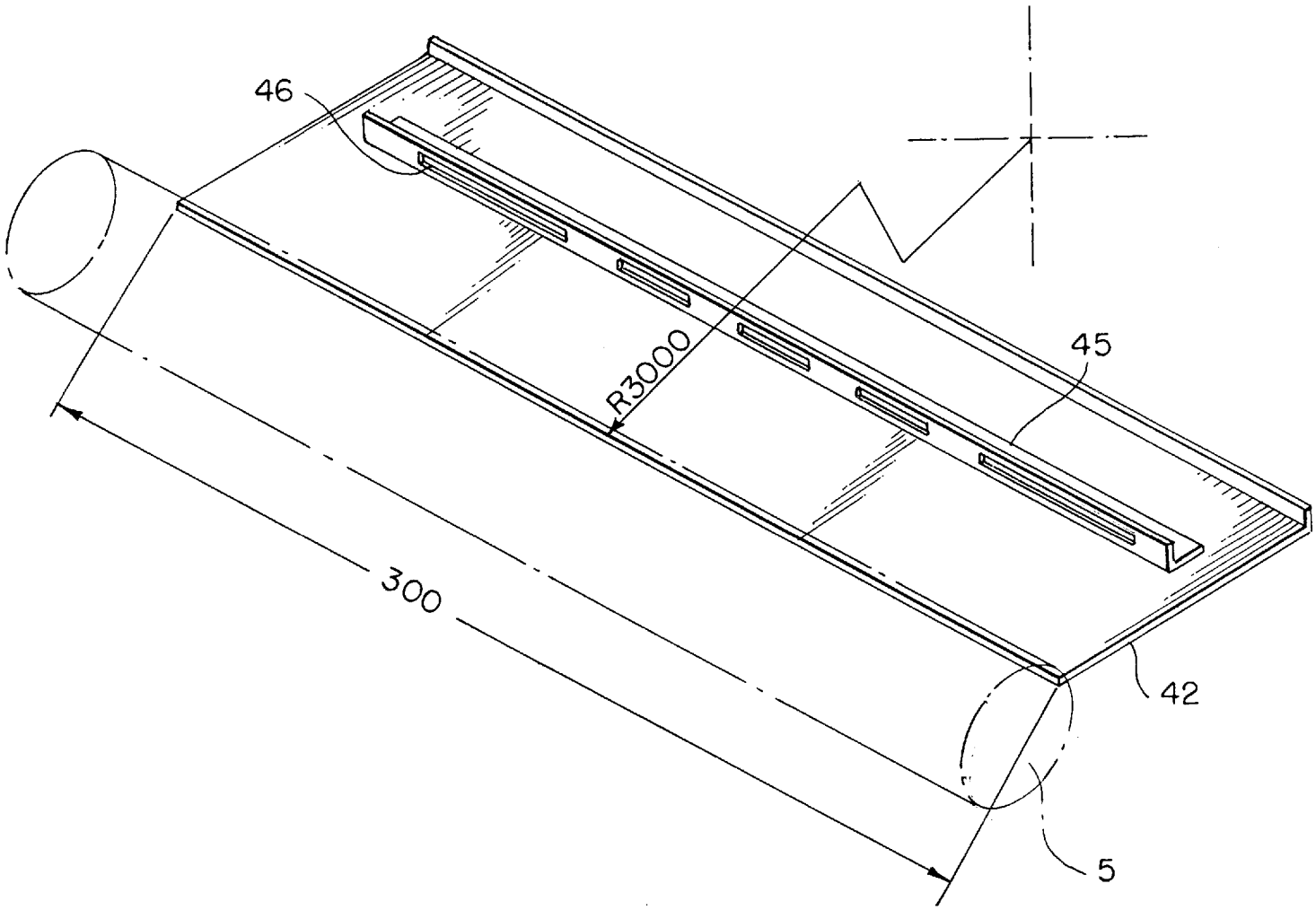
FIG. 10 is a perspective view of a partitioning member having an arc-shaped front end.

Therefore, as shown in FIG. 10, the front end of the partitioning member 42 is shaped into an arc having a width of about 300 mm and a radius of 3000 mm, for example. Since the front end of the partitioning member 42 is shaped into a large streamline form as described above, outside air is drawn in at a high flow rate from both ends of the toner passage 20. The toner flows smoothly without lingering. The easiness of passage of the toner between the photosensitive body 5 and the partitioning member 42 is improved without affecting the image quality. Therefore, the easiness of passage of the toner can be maintained against deterioration of the fluidity of the toner under high-temperature humid conditions. Consequently, the toner does not clog up and thus the attracting force of the attracting fan is prevented from deteriorating.

Third Embodiment

Figure 11:
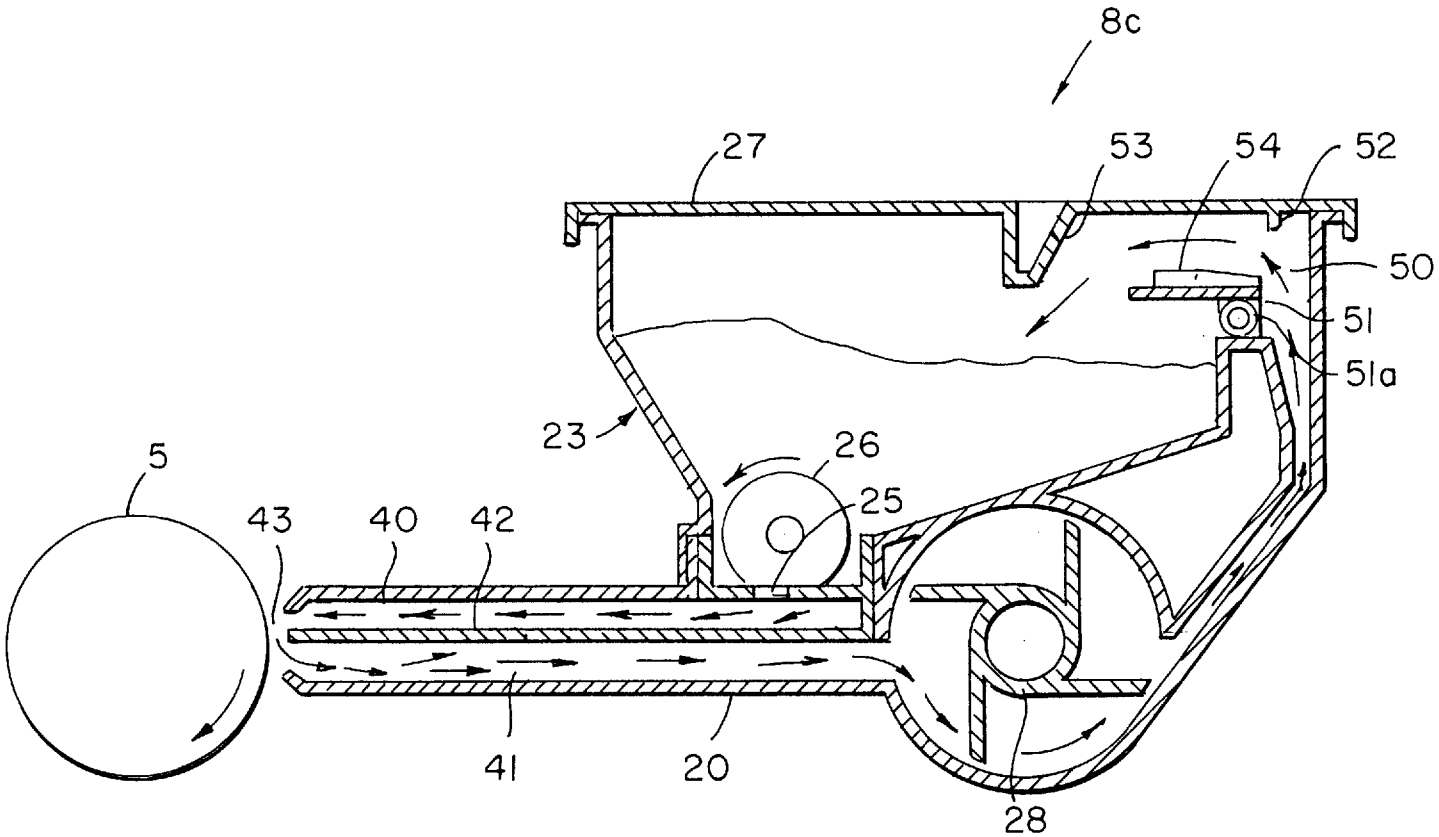
FIG. 11 is a cross-sectional view showing the fundamental structure of a development apparatus 8*c* forming a third embodiment of the invention.

FIG. 11 is a cross-sectional view showing the fundamental structure of a development apparatus forming a third embodiment of the invention. This development apparatus, indicated by 8*c*, has a toner passage 20 that extends from a toner storage container 23 to the vicinity of a photosensitive body 5 and again into the toner storage container 23, thus forming a circulatory passage. The toner recovery container used in the above-described embodiments is dispensed with. This third embodiment is similar to the second embodiment in other respects.

The attracting fan 28 is located in the downstream passage 41 of the toner passage 20. A downstream side of the fan 28 is in communication with a recovery port 50 formed at the top of the toner storage container 23. A shutter 51 is mounted in this recovery port 50 to close off this port 50 in order to prevent the toner from spilling out from the toner storage container 23 during transportation of the development apparatus or in other similar situations. The shutter 51 is rotatably held to the container 23 via a shaft 51*a*. Ribs 52 protrude from the top cover 27 and bear against the shutter 51. The shutter 51 is rotated by a motor, solenoid, or the like. As a development operation commences, the shutter 51 opens. When the development ends, the shutter is closed and bears against the ribs 52, thus closing off the recovery port 50.

A guide wall 53 protrudes from the top cover 27 and is located opposite to the recovery port 50. The surface of the wall opposite to the port is tilted to guide the toner powder stream downward, the powder stream being entered through the recovery port 50. The toner storage container 23 is provided with an air-venting hole.

Figure 12:
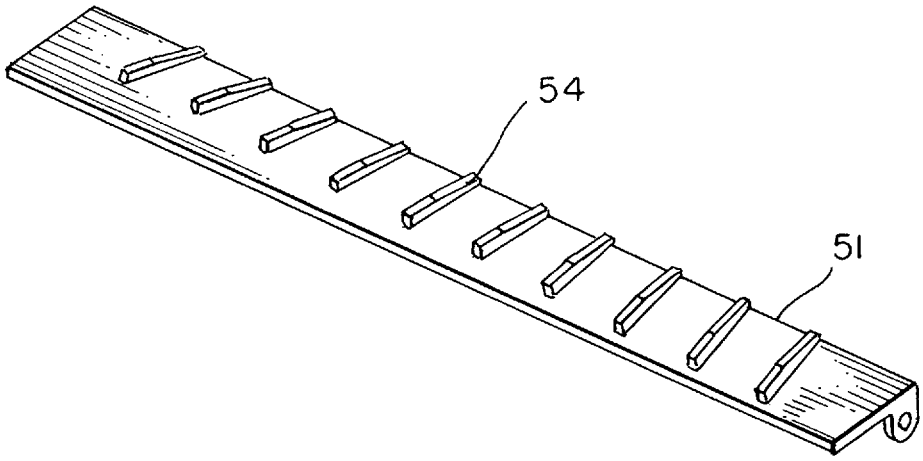
FIG. 12 is a perspective view of a shutter.

A plurality of guide ribs 54 are formed on the shutter 51, as shown in FIG. 12. These guide ribs act as a recovery member that disperses the toner uniformly in the longitudinal direction and prevents nonuniform recovery of the toner when it is sent from the recovery port 50 into the toner storage container 23. The guide ribs are tilted from their center toward their opposite ends so that the toner powder stream flows toward the ends. As an example, two center guide ribs 54 are set parallel. Two guide ribs 54 adjacent to each of these center ribs are inclined at an angle of 10° to the ends. The two extreme guide ribs 54 are inclined at an angle of 15° to the ends. Thus, the toner forced into the container by wind force is dispersed inside the toner storage container 23 by the guide ribs 54 on the shutter 51. Then, the toner is recovered. Hence, the toner does not stay on one side within the container 23. The recovered toner is mixed with the used toner uniformly. The toner particles inside the container 23 are made uniform in size. Also, charging characteristics and so on of the toner are averaged.

The guide ribs 54 are formed on the shutter 51. It is only necessary that the ribs be located upstream of the toner storage container 23. The guide ribs may also be formed on the wall surface of the downstream passage 41 near the recovery port 50. Furthermore, it is possible to divide the interior of the downstream passage 41 into plural sections, for dispersing the toner powder stream.

In this structure, the toner supplied from the toner supply roller 26 to an upstream passage 40 is attracted by the attracting fan 28 and then reaches the opening 43. The toner then flies toward the photosensitive body 5 and is used for development. Excess toner not used for the development is sent into the toner storage container 23 via the downstream passage 41. The toner powder stream passed through the recovery port 50 is dispersed in the longitudinal direction by the guide ribs 54 and allowed to fall along the inclined surfaces of the guide wall 53. Then, the toner sits, and is kept uniformly distributed, on the toner already retained in the storage container 23. The toner is stirred along with unused toner, triboelectrically charged, and supplied into the toner passage 20. Thus, the toner is reused.

Since the toner is therefore circulated, the toner can be reused. Consequently, the toner replenishment cycle can be set long, and the running cost can be reduced. Moreover, the toner recovery container can be dispensed with. The toner passage 20 can be shortened. Hence, the development apparatus can be made smaller. In this way, further space saving can be accomplished.

Figure 13:
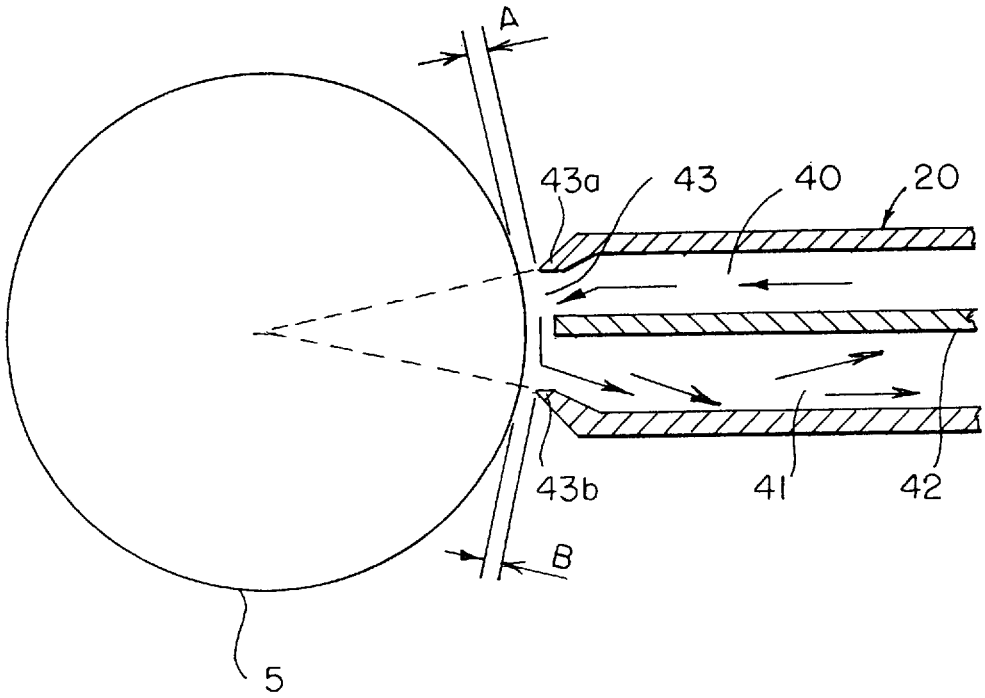
FIG. 13 is a view particularly showing the front end of a developer passage.

To improve the image quality, we have discussed the behavior of the toner powder stream when it makes a U-turn near the opening 43. First, the attracting fan 28 is set into operation to draw the toner powder stream toward the downstream passage 41. Outside air is also sucked from the opening 43. Because of the shape of the front end of the opening 43, outside air is introduced at a larger rate at the upstream side than at the downstream side. This reduces the density of the toner powder stream, thus causing a deterioration of the image density. Accordingly, in order to suppress suction of outside air from the upstream end side, the space A between the upstream end portion 43*a* of the opening 43 and the photosensitive body 5 is set smaller than the space B between the downstream end portion 43*b* and the photosensitive body 5, as shown in FIG. 13. The upstream end portion 43*a* is placed closer to the photosensitive body 5.

This reduces the suction of outside air from the space A between the upstream end portion 43*a* of the opening 43 and the photosensitive body 5. Nonuniformities in the density of the toner powder stream near the opening 43 can be eliminated. The image concentration is prevented from dropping and thus the image quality can be enhanced.

Figure 14:
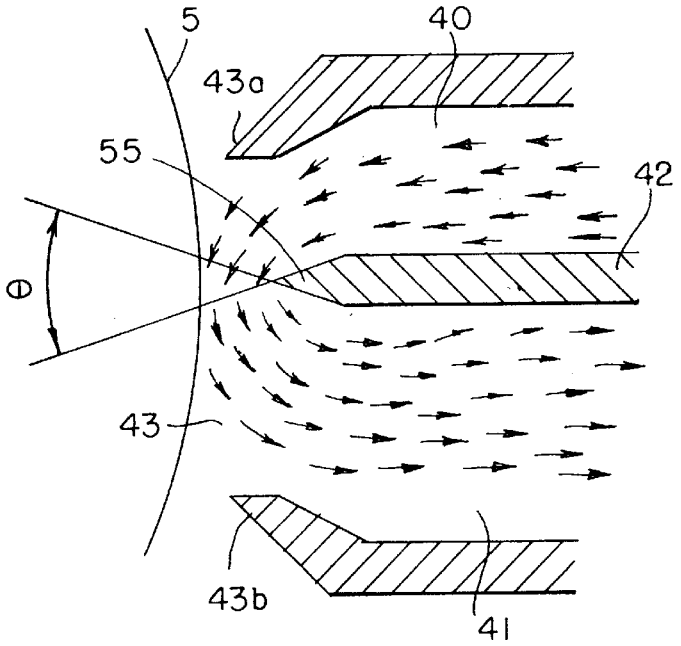
FIG. 14 is a view particularly showing the front end of a partitioning member.

The powder stream of the toner makes a U-turn around the front end of the partitioning member 42 and so the shape of the front end of the partitioning member 42 affects the toner powder stream. Therefore, as shown in FIG. 14, the front end of the partitioning member 42 is shaped into a peak 55 making an acute angle θ.

This shape can prevent disturbance of the applied voltage due to the thickness of the partitioning member 42 made of a conductive member or due to burrs produced by punching of a sheet metal done during the fabrication of the partitioning member 42. Also, the flow of the toner smoothens. Therefore, adhesion of the toner to nonimage areas, blurring of characters, and other defective output prints can be prevented. Consequently, a clear image free of blurred characters is obtained.

Figure 15:
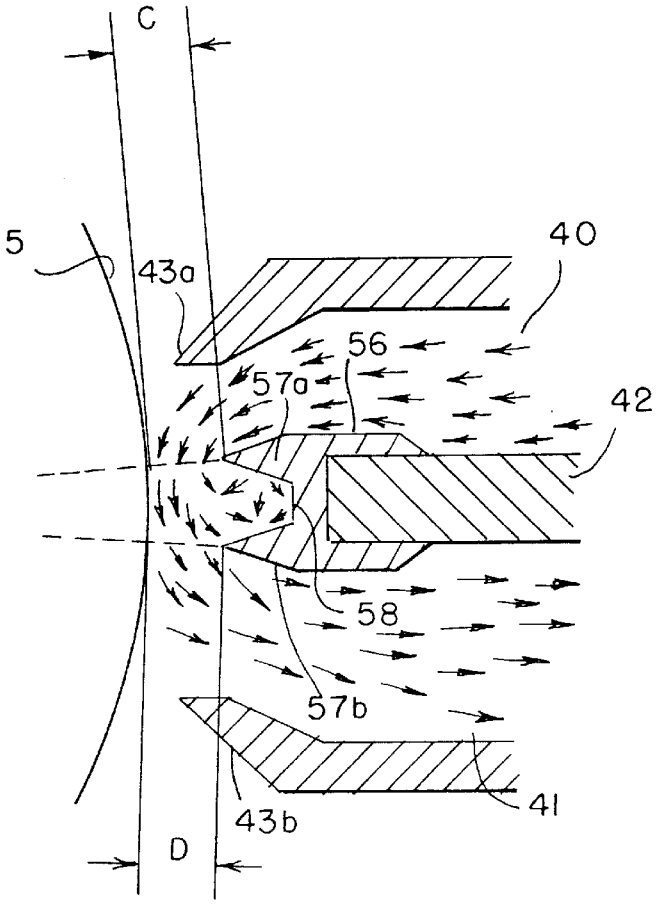
FIG. 15 is a view particularly showing the front end of another partitioning member.

Another front end shape is shown in FIG. 15, where a conductive block 56 made of copper or the like is fitted and held over the front end of the partitioning member 42. This block 56 has two peaks 57*a* and 57*b* and an intervening flat recess 58. Instead of preparing the conductive block 56, the front end of the partitioning member 42 may be shaped into the above-described form by press working, cutting operation, or the like.

Thus, an eddy stream is produced in the recess 58 between the peaks 57*a* and 57*b* when the powder stream of the toner makes a U-turn around the front end of the partitioning member 42. This secures a given nip on the photosensitive body 5, thus assuring contact between the powder stream of the toner and the photosensitive body 5. Accordingly, even when the supply of the toner becomes insufficient due to a variation of the fluidity of the toner, copying of a high-concentration document, or other cause, the supply of the toner to the photosensitive body 5 is sufficient. This can prevent the image concentration from deteriorating.

In this case, to improve the image quality further, the space C between the peak 57*a* on the upstream side and the photosensitive body 5 is set smaller than the space D between the peak 57*b* on the downstream side and the photosensitive body 5 (i.e., C<D). The peak 57*a* on the upstream side is positioned closer to the photosensitive body 5 than the peak 57*b* on the downstream side. Specifically, when the relation C>D was established, the toner colliding against the downstream peak 57*b* would be repelled upward. The amount of this repelling is sensitive to the attracting force, and due to variation of the attracting force, the toner density above the peak 57*a* on the upstream side varies. This weakens the stabilizing effects of the eddy created in the recess 58 on the toner density. As a result, the performance of the development is affected greatly by the attracting force of the attracting fan 28. Variations of the input bias voltage tend to produce nonuniformities in the image quality. However, by establishing the relationship C<D, the toner is less repelled, thus augmenting the stabilizing effect of the eddy created in the recess 58 on the toner density. Therefore, the toner density can be maintained uniform by a simple method (e.g., striking a balance between both spaces). Low image quality due to nonuniformities in the density of the toner powder stream can be prevented.

Figure 16:
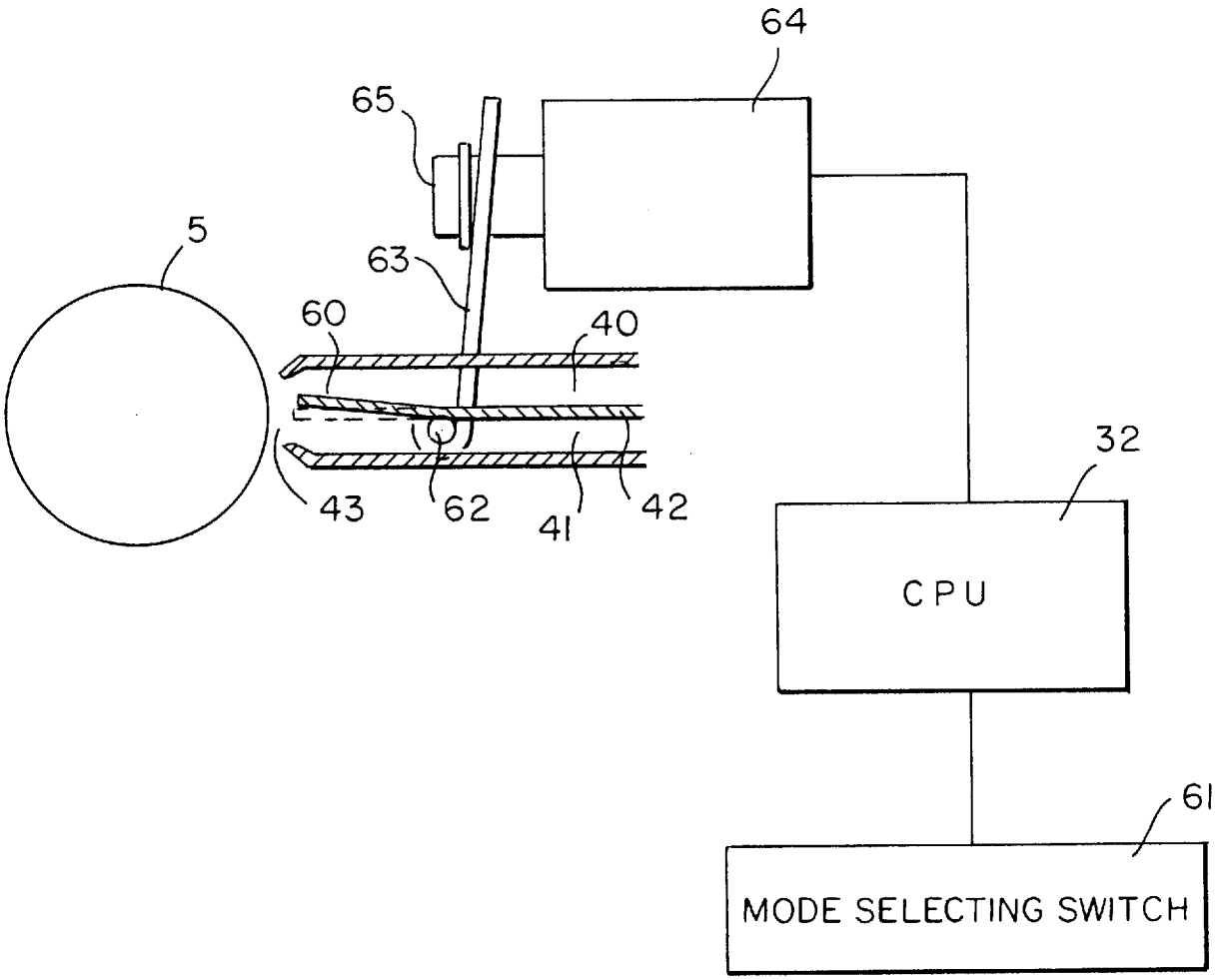
FIG. 16 is a cross-sectional view showing the fundamental structure of a development apparatus having an opening-controlling function.

In recent years, it has been required that documents containing large amounts of halftones such as photographs be reproduced faithfully. Therefore, a normal character reproduction mode and a photograph mode for reproducing halftones faithfully are established by settings of the charging potential or the copy lamp light amount. The user performs operations to select a desired image quality. For this purpose, the toner powder stream near the opening 43 may be changed according to the selected copy mode. Accordingly, as shown in FIG. 16, a movable part 60 is attached to the front end of the partitioning member 42 to vary the shape of the opening. An opening control function is imparted to the CPU 32 of the printer so that the movable part 60 is activated according to the copy mode selected by operating a mode-selecting switch 61. Thus, the image quality is adjusted.

The movable part 60 is a separated part of the front end of the partitioning member 42, and is held inside the toner passage 20 so as to be vertically rotatable around a shaft 62. One end of a connecting rod 63 is attached to the movable part 60, while the other end is connected to a rod 65 of a solenoid 64 acting as a driving member. When the solenoid 64 is activated in response to a driving signal from the CPU 32, the movable part 60 moves slightly upward from its normal position where the part 60 is flush with the partitioning member 42. This narrows the opening on the upstream side and widens the opening on the downstream side.

More specifically, when the user operates the modeselecting switch 61 to select the photograph mode, the CPU 32 activates the solenoid 64 to slightly raise the movable part 60. This controls the incident angle of the toner powder stream to the photosensitive body 5 so that the stream is almost tangential to the photosensitive body 5. As a result, the toner powder stream touches the photosensitive body 5 from the upstream side of the surface. The toner comes into a soft contact with the surface of the photosensitive body 5 when the toner makes a U-turn. Consequently, the toner can follow subtle potential differences at halftones. Thus, halftone documents such as photographs can be reproduced more faithfully. When the normal character reproduction mode is selected, the solenoid 64 is not activated. The movable part 60 is retained in its normal state.

Figure 17:
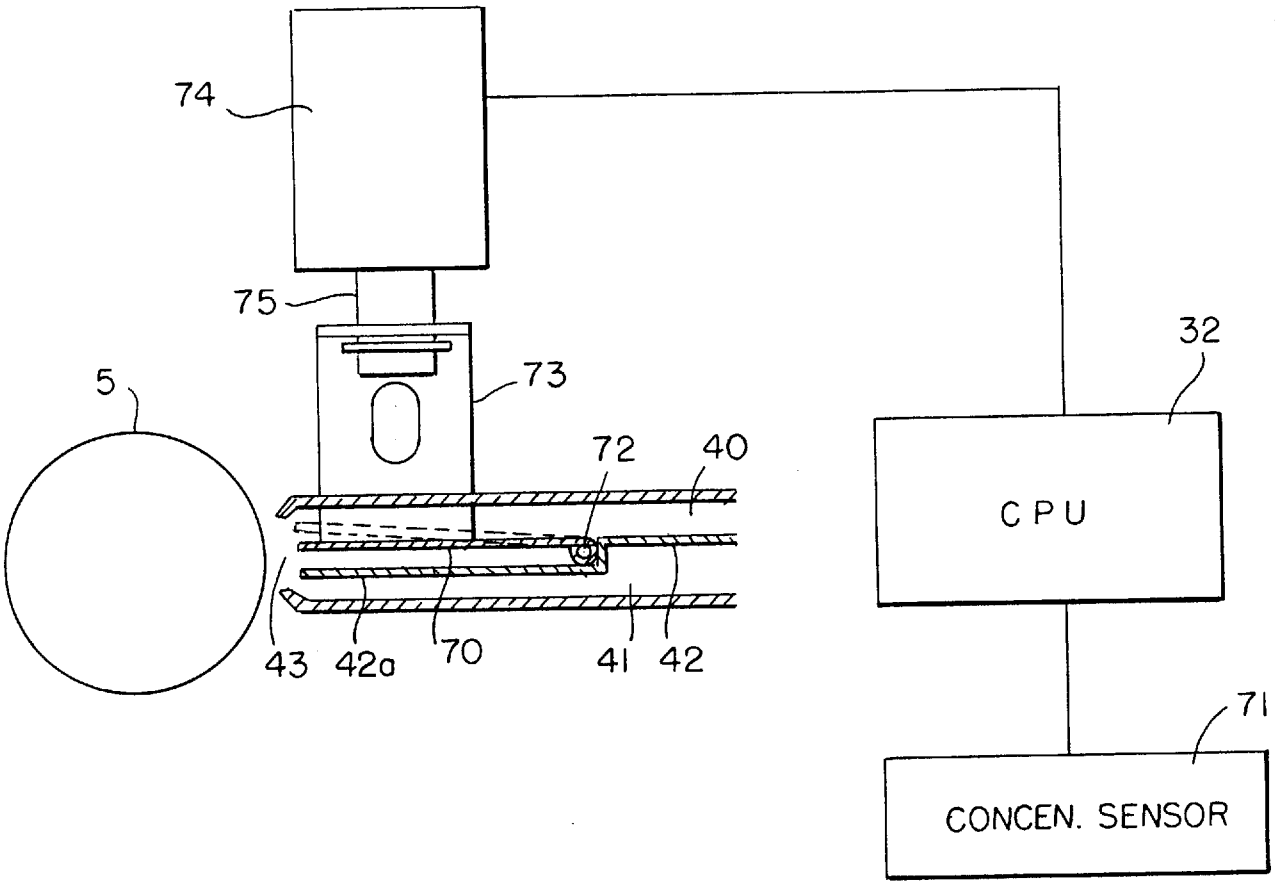
FIG. 17 is a cross-sectional view showing the fundamental structure of a development apparatus having another opening-controlling function.

The concentration differs greatly according to the document. In the case of a high-concentration document, the supply of the toner cannot follow, and there is the possibility that the concentration drops after successive copies or prints are made. Accordingly, as shown in FIG. 17, a movable part 70 is mounted at the front end of the partitioning member 42 so that the partitioning member 42 has plural front ends. Using these front ends, the shape of the opening is varied. An opening-controlling function is imparted to the CPU 32 of the printer. A document concentration sensor 71 senses the concentration of the document from the ratio of the area of characters to the document area according to a signal from the document reader or a computer that represents recorded information. The CPU operates the movable part 70 according to the output data from the document concentration sensor 71 to adjust the image quality.

The partitioning member 42 has a front end portion 42*a* bent toward a downstream passage 41. The front end portion 42*a* is recessed on the side of an upstream passage 40. The flat movable part 70 is mounted in this recess. The movable part 70 is held to the partitioning member 42 so as to be rotatable around a shaft 72. Under a normal condition, the movable part 70 is spaced a given distance from the front end portion 42*a* of the partitioning member 42, and is parallel to the front end portion 42*a*. Also, the movable part 70 is flush with the partitioning member 42. One end of a connecting plate 73 is mounted to the movable part 70. The other end of the connecting plate 73 is connected to a rod 75 of a solenoid 74 serving as a driving member. When the solenoid 74 is set into operation according to a driving signal from the CPU 32, the movable part 70 is rotated slightly upward from its normal position where the movable part 70 is flush with the partitioning member 42. Thus, the movable part 70 is spaced a greater distance from the front end portion 42*a* of the partitioning member 42. This narrows the opening on the side of the upstream passage. However, the nip on the photosensitive body 5 is increased. In this way, the toner powder stream near the opening 43 is controlled.

More specifically, the CPU 32 previously calculates the toner consumption ratio (character printed ratio) that is the ratio of the area consumed by the toner to the document area, from the output data from the document concentration sensor 71. For example, where the character printed ratio exceeds 50%, the CPU 32 drives the solenoid 74 to slightly raise the movable part 70. This increases the space between the movable part 70 and the front end portion 42*a* of the partitioning member 42, resulting in an increase of the nip on the photosensitive body 5. In consequence, the toner powder stream makes a U-turn with an increased width. The toner touches the photosensitive body 5 with an increased area for a prolonged time. As a result, the response of the toner is enhanced. Even when the toner is consumed in quantities, the supplied toner will suffice for the development. Hence, the document can be reproduced more faithfully. Especially, where successive copies or prints of a high-concentration document are made, the concentration can be prevented from deteriorating. Where the printed character ratio is not in excess of 50%, the solenoid 74 does not operate. The movable part 70 is retained in its normal state. The space between the movable part 70 and the front end portion 42*a* of the partitioning member 42 is kept small. A small nip is formed on the photosensitive body 5.

When an electric motor is used instead of the solenoid to rotate a movable member such as the movable part 60 or 70, the angular position of the movable part can be changed continuously rather than switched between two positions. It is possible to accommodate itself to the kind and concentration of document finely. The document can be reproduced more faithfully. In consequence, the image quality can be improved.

Fourth Embodiment

Figure 18:
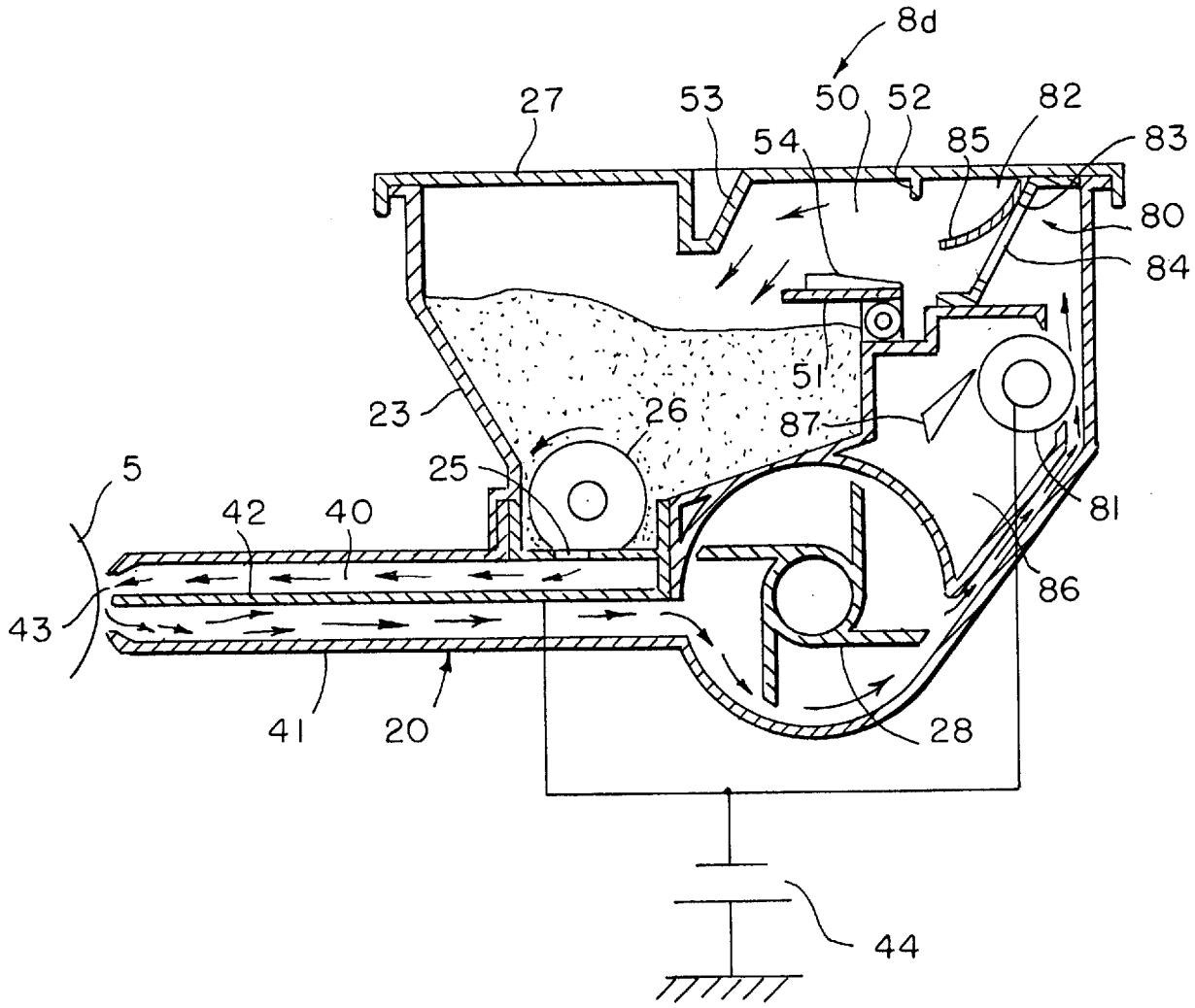
FIG. 18 is a cross-sectional view showing the fundamental structure of a development apparatus 8*d* forming a fourth embodiment of the invention.

FIG. 18 is a cross-sectional view showing the fundamental structure of a development apparatus, forming a fourth embodiment. This development apparatus, indicated by 8*d*, has a toner passage 20 in which a pressure-adjusting valve 80 is mounted upstream of a recovery port 50 of a toner storage container 23. This pressure-adjusting valve 80 acts as a recovery member for preventing nonuniformities in the toner recovered. The toner contains several percent reversely charged toner generated during production of the toner and during development. This reversely charged toner impairs the characteristics of the toner held in the toner storage container 23. A toner recovery roller 81 acting as an reversely charged toner recovery member is mounted to recover the reversely charged toner. This embodiment is similar to the third embodiment in other respects.

A pressure chamber 82 is formed upstream of the recovery port 50 of the toner storage container 23. A tilted plate 83 is mounted inside the pressure chamber 82. A valve port 84 is formed in the center of the tilted plate 83. The pressure-adjusting valve 80 comprises a thin resilient plate 85 made of rubber, a metal, plastic, or the like to open and close the valve port 84. One end of the thin plate 85 is securely fixed to the side of the tilted plate 83 that is located opposite to the recovery port 50, the other end being a free end.

This pressure-adjusting valve 80 varies the area of the opening of the valve port 84 according to nonuniformities in the pressure produced by the varying amount of the toner recovered, thus suppressing nonuniformities in the attraction. For example, where the amount of the recovered toner is large, or where the velocity of the toner powder stream is high, the pressure applied to the thin plate 85 of the pressure-adjusting valve 80 is high, so that the thin plate 85 is distorted to a large extent. This increases the area of the opening of the valve port 84. Hence, the stream flows smoothly, eliminating the nonuniformities in the pressure. Where the amount of the toner recovered is small, or where the toner powder stream is low, the thin plate 85 is distorted to a small extent. This reduces the area of the opening of the valve port 84, removing the nonuniformities in the pressure.

Since the pressure-adjusting valve 80 smoothes out the nonuniformities in the pressure according to the amount of recovered toner in this way, a constant attracting force is obtained. This eliminates the nonuniformities in the attraction. Therefore, the toner can be recovered stably. Especially in reproduction of halftone images, a stable toner powder stream is produced. Consequently, a good image free of nonuniformities is derived.

The toner recovery roller 81 is located between the attracting fan 28 in a downstream passage 41 and the pressure-adjusting valve 80. The roller 81 comprises a conductive shaft as made of a stainless steel and coated with urethane sponge. The roller 81 is electrically charged with the same polarity as the toner and electrically connected with a partitioning member 42. A bias voltage is applied to the roller 81, in the same way as the partitioning member 42. The space between the downstream passage 41 and the toner storage container 23 forms a waste toner-receiving chamber 86. The toner recovery roller 81 is rotatably held inside the waste toner-receiving chamber 86. The roller 81 partially extends into the downstream passage 41. During development, the roller 81 is kept rotated. A scraper 87 for scraping the reversely charged toner from the toner recovery roller 81 is in sliding contact with the toner recovery roller 81.

Since the toner recovery roller 81 is charged with the same polarity as the toner in this way, several percent reversely charged toner generated during production of the toner and during development can be recovered by causing the toner to adhere to the roller 81. Furthermore, the reversely charged toner can be readily attracted, because a bias voltage is impressed on the toner recovery roller 81. Therefore, the reversely charged toner passing through the downstream passage 41 is attracted to the toner recovery roller 81 and adheres to the surface. Then, the toner is scraped off by the scraper 87 and received into the waste toner-receiving chamber 86. This can prevent the reversely charged toner in the toner storage container 23 from increasing in amount. Consequently, the characteristics of the toner can be prevented from deteriorating.

Fifth Embodiment

Figure 19:
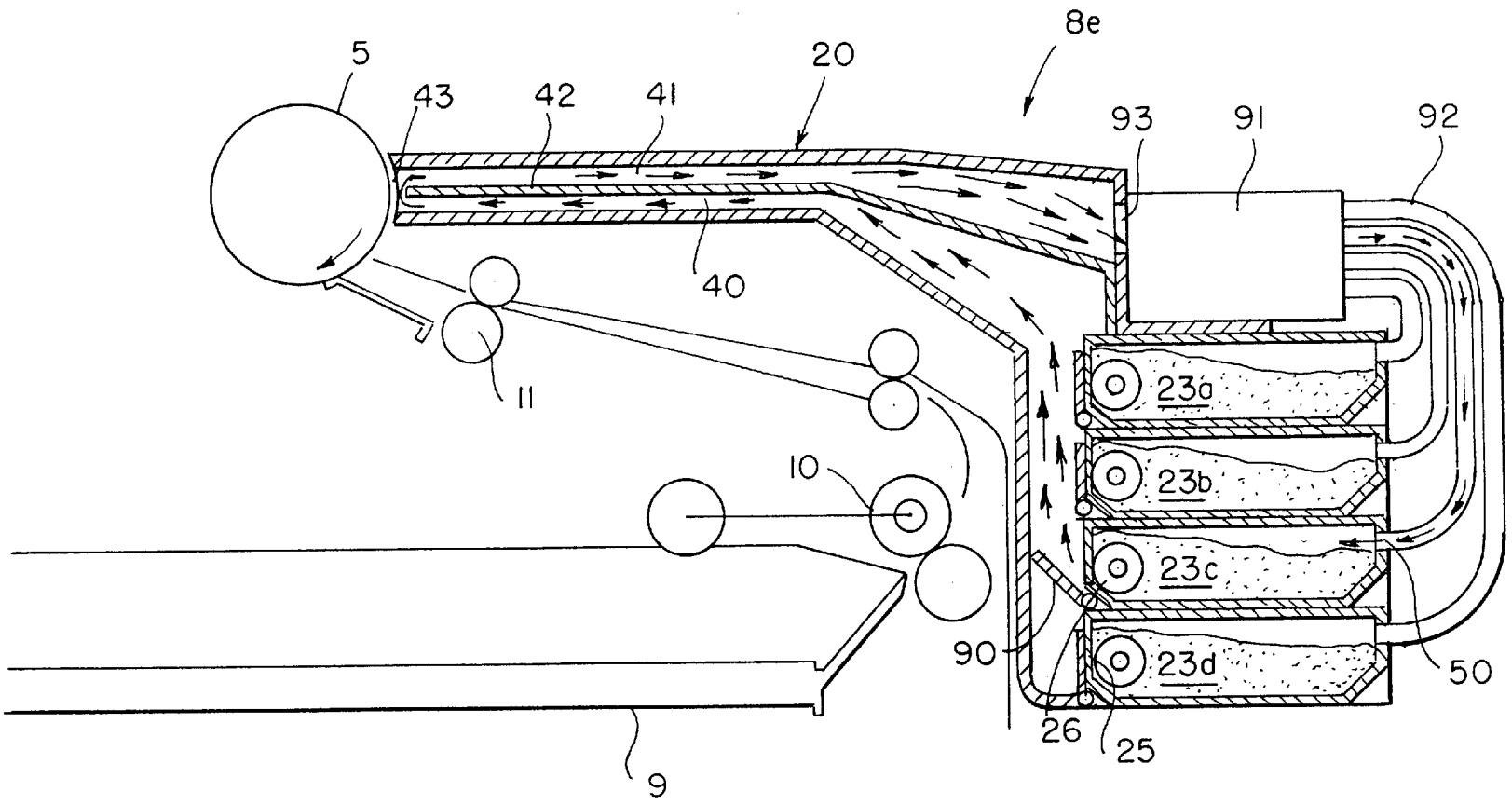
FIG. 19 is a cross-sectional view showing the fundamental structure of a development apparatus 8*e* forming a fifth embodiment of the invention.

FIG. 19 is a cross-sectional view showing the fundamental structure of a development apparatus forming a fifth embodiment. This development apparatus, indicated by 8*e*, is adapted for full-color development and comprises four toner storage containers 23*a*, 23*b*, 23*c*, 23*d* in which toners of black, magenta, cyan, and yellow, respectively, are held, a toner passage 20, and a distributing member for switching the passage to return toners not used for development to their original storage containers 23*a*, 23*b*, 23*c*, and 23*d*. The toner passage 20 consists of an upstream passage 40 and a downstream passage 41 through which the toners supplied from the toner storage containers 23*a*, 23*b*, 23*c*, and 23*d* pass. The operating principle of the development is fundamentally the same as that of the above-described embodiments.

The toner storage containers 23*a*, 23*b*, 23*c*, and 23*d* are provided with supply ports 25 opposite to the upstream passage 40. Toner supply rollers 26 are rotatably mounted in the supply ports 25, respectively. The toner supply rollers 26 are similar in structure to those of the above-described embodiments. Toner supply shutters 90 are rotatably mounted to open and close the supply ports 25 in the toner storage containers 23*a*, 23*b*, 23*c*, and 23*d*. The shutters are activated by solenoids or motors so that a toner of one color is supplied at a time.

The distributing member comprises a flow divider 91 mounted in an end portion of the downstream passage 41 and four recovery passages 92 connected with the toner storage containers 23*a*, 23*b*, 23*c*, and 23*d*,respectively. A communication port 93 is formed between the downstream passage 41 and the flow divider 91, and a shutter (not shown) for opening and closing the communication port 93 is mounted. The flow divider 91 acts as a valve for switching the entrance to the recovery passages 92 so that the toners of the various colors sent through the downstream passage 41 are discharged into the recovery passages 92 for the corresponding colors. An attracting fan is mounted inside the flow divider 91. The toner supply shutter 90 and the flow divider 91 are driven according to a color-selecting signal from the CPU 32 of the printer.

In this structure, where development is made, using the toner of cyan, for example, the toner supply roller 26 for the toner storage container 23*c* holding the toner of cyan therein is driven. Also, the toner supply shutter 90 closing off the supply port 25 is opened. The shutter closing the communication port 93 is also opened. The attracting fan is operated to attract the toner. This toner becomes a toner powder stream and reaches the opening 43, where the toner is used for development. The toner not used for the development is drawn into the downstream passage 41 intact. Then, the toner is guided into the recovery passage 92 in communication with the cyan toner storage container 23*c* whose entrance has been opened by the flow divider 91. The toner is subsequently recovered into the toner storage container 23*c* through the recovery port 50. The toners of the other colors are similarly supplied from the toner storage containers 23*a*, 23*b*, 23*d* into the toner passage 20. The toners are circulated and sent back into the toner storage containers 23*a*, 23*b*, and 23*d* and reused.

Accordingly, even in a full-color development apparatus employing toners of multiple colors, only one toner passage 20 needs to be disposed around the photosensitive body 5. Therefore, the development apparatus can be installed at a desired position with increased degrees of freedom. The layout inside the machine can be set arbitrarily and space saving is accomplished.

In the aforementioned full-color development apparatus 8*e*, the toner passage 20 is a circulatory passage. This structure can also be applied to the development apparatuss 8*a*, 8*b* of the first and second embodiments, and in which case no distributing member is necessary. The toners are supplied from the toner storage containers 23*a*, 23*b*, 23*c*, and 23*d*, one color at a time. The used toners are recovered into the toner recovery containers.

It is to be noted that the present invention is not limited to the embodiments described above and that various changes and modifications can be made thereto within the scope of the invention. In the first embodiment, where the upstream end of the opening 21 of the toner passage 20 is placed closer to the photosensitive body 5 than the downstream end, suction of outside air through the gap between the upstream end of the opening 21 and the photosensitive body 5 is suppressed. This can eliminate nonuniformities in the density of the toner powder stream near the opening 21. The image concentration is prevented from dropping. Thus, the image quality can be improved.

Figure 20A:
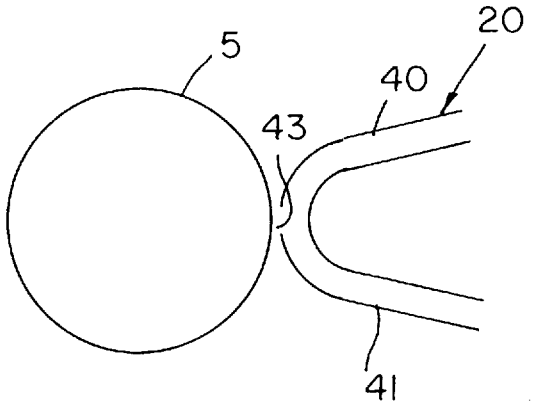
FIGS. 20A–20C are views of other developer passages.
Figure 20B:
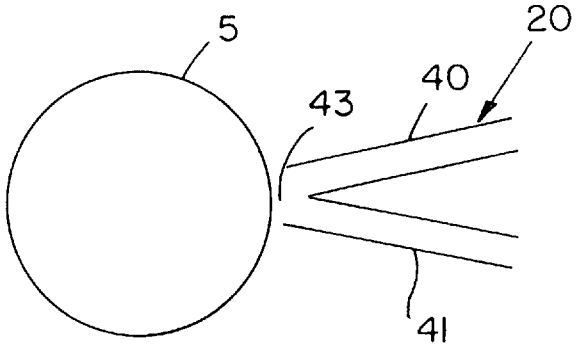
Figure 20C:
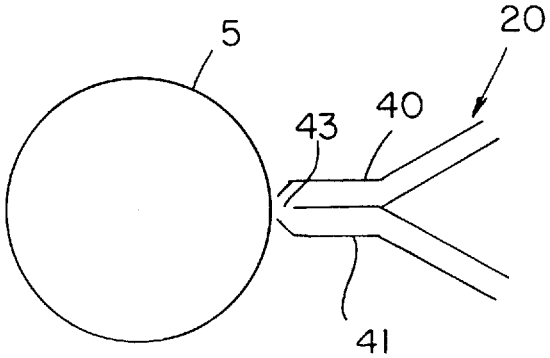

In the second and third embodiments, the upstream passage 40 and the downstream passage 41 of the toner passage 20 have no need to be adjacent to each other. As shown in FIGS. 20A–20C, the toner passage 20 may be shaped into a U-, V-, or Y-shaped form, and toner storage containers and other components may be disposed in the space between both passages 40 and 41.

Doors may be mounted in the openings 21 and 43 of the toner passage 20. The doors are moved according to the size of the transfer paper. The movement of the doors may be controlled so as to vary the longitudinal dimensions of the openings 21 and 43. Where the size of the transfer paper is large, the openings 21 and 43 are opened full. Where the paper size is small, the doors are moved to narrow the openings 21 and 43. The width of the toner powder stream near the openings 21 and 43 can be matched to the image areas on the photosensitive body 5. Adhesion of the toner to the nonimage areas can be avoided. Hence, the image quality can be improved.

Where a turbine rotor is mounted in the upstream passage 40 or located in the toner passage 20 upstream of the opening 21, the toner powder stream rotates the turbine rotor to thereby stir the passing toner. This increases the charge level of the toner and disperses it. Therefore, the density of the toner powder stream is made uniform. Consequently, the image quality can be improved.

The invention may be embodied in other specific forms without departing from the sprit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A development apparatus using a nonmagnetic one-component developer comprising:

a developer passage through which the nonmagnetic one-component developer passes;

supply means for supplying the developer into the developer passage; and attracting means for attracting the developer existing in the developer passage to produce a powder stream, wherein the developer passage includes an upstream passage for feeding the developer from the supply means toward an electrostatic latent image holder body, and a downstream passage for recovering the developer which was not used for development, and a developing opening which faces the electrostatic latent image holder body is formed at a junction of the upstream and downstream passages wherein the upstream and downstream passages are adjacent to each other and a partitioning member is provided for partitioning the upstream and downstream passages.

2. A development apparatus using a nonmagnetic one-component developer comprising:

a developer passage through which the nonmagnetic one-component developer passes;

supply means for supplying the developer into the developer passage; and attracting means for attracting the developer existing in the developer passage to produce a powder stream, wherein the developer passage includes an upstream passage for feeding the developer from the supply means toward an electrostatic latent image holder body, and a downstream passage for recovering the developer which was not used for development, and a developing opening which faces the electrostatic latent image holder body is formed at a junction of the upstream and downstream passages wherein the upstream and downstream passages are adjacent to each other and a partitioning member is provided for partitioning the upstream and downstream passages; and wherein the developer passage is a circulatory passage disposed close to the electrostatic latent image holder body from the supply means and reaches the supply means, the developer passage having formed therein a developing opening which faces the electrostatic latent image holder body.

3. The development apparatus using a nonmagnetic one-component developer of claim 2, wherein the supply means includes a plurality of developer storage containers for respectively holding developers of different colors and recovering passages for recovering the developers supplied from the respective developer storage containers to restore to the corresponding developer storage containers, the developing apparatus further comprising distribution means provided in the developer passage downstream from the developing opening, for carrying out a changeover among the recovering passages so that a recovering passage connecting to a developer storage container for a developer to be recovered is operatively connected with the developer passage.

4. The development apparatus using a nonmagnetic one-component developer of claim 2, wherein a reversely-charged developer recovery member charged with the same polarity as that of the developer is provided in the developer passage downstream from the developing opening.

5. The development apparatus using a nonmagnetic one-component developer of claim 1 or 2, wherein the partitioning member is made of a conductor, and a bias voltage is applied to the partitioning member.

6. The development apparatus using a nonmagnetic one-component developer of any one of claims 1 and 2, wherein control means is provided for controlling the powder stream of developer according to surrounding circumstances to maintain uniform image quality.

7. The development apparatus using a nonmagnetic one-component developer of any one of claims 1 and 2, wherein a movable member for varying the developing opening in shape is provided at the developing opening, and opening control means is provided for activating the movable member to vary the powder stream of developer near the developing opening according to a required image.

* * * * *